US009320352B2

(12) United States Patent
Blackburn

(10) Patent No.: US 9,320,352 B2
(45) Date of Patent: Apr. 26, 2016

(54) ARTICULATING SUPPORT ARM

(71) Applicant: Knape & Vogt Manufacturing Company, Grand Rapids, MI (US)

(72) Inventor: Nicholas Leonard Blackburn, Wellesley (CA)

(73) Assignee: Knape & Vogt Manufacturing Company, Grand Rapids, MI (US)

( * ) Notice: Subject to any disclaimer, the term of this patent is extended or adjusted under 35 U.S.C. 154(b) by 0 days.

(21) Appl. No.: 14/597,941

(22) Filed: Jan. 15, 2015

(65) Prior Publication Data

US 2015/0201747 A1 Jul. 23, 2015

Related U.S. Application Data

(60) Provisional application No. 61/928,816, filed on Jan. 17, 2014.

(51) Int. Cl.
*A47B 11/00* (2006.01)
*A47B 21/03* (2006.01)

(52) U.S. Cl.
CPC ..... *A47B 21/0314* (2013.01); *A47B 2021/0328* (2013.01); *A47B 2021/0335* (2013.01)

(58) Field of Classification Search
CPC ..... A47B 2021/0321; A47B 2021/0328; A47B 2021/0335; A47B 2021/0342; A47B 2021/035; A47B 21/0314
USPC ..... 108/5, 9, 2, 4, 7, 138, 143, 140, 139; 248/276.1, 918, 923, 284.1, 292.11, 248/296.1, 299.1, 371, 281.11, 229.1, 286.1
See application file for complete search history.

(56) References Cited

U.S. PATENT DOCUMENTS 4,616,798 A * 10/1986 Smeenge ..... A47B 21/0314 108/69
4,625,657 A * 12/1986 Little ..... A47B 21/0314 108/138
4,644,875 A 2/1987 Watt
5,037,054 A 8/1991 McConnell
5,145,136 A 9/1992 McConnell
5,211,367 A 5/1993 Musculus
5,257,767 A 11/1993 McConnell
5,302,015 A * 4/1994 Du Vall ..... A47B 21/0314 248/286.1
5,513,579 A 5/1996 Allan
5,685,235 A 11/1997 Allan
5,697,303 A 12/1997 Allan
5,878,674 A 3/1999 Allan
6,021,985 A * 2/2000 Hahn ..... A47B 21/0314 248/279.1
6,027,090 A * 2/2000 Liu ..... A47B 21/0314 248/278.1
6,158,359 A 12/2000 Allan et al.
6,186,460 B1 * 2/2001 Lin ..... A47B 21/0314 248/278.1
6,199,809 B1 * 3/2001 Hung ..... A47B 21/0314 248/281.11
6,322,031 B1 11/2001 LeClair et al.
6,397,763 B1 * 6/2002 Panzarella ..... A47B 21/0314 108/138
6,409,127 B1 6/2002 VanderHeide et al.

(Continued)

*Primary Examiner* — Jose V Chen
(74) *Attorney, Agent, or Firm* — Cook Alex Ltd.

(57) ABSTRACT

An articulating support arm includes a base, at least first and second links, a control head and a platform. The base, first and second links and control head are pivotally connected in a four bar linkage configuration. The control head has a forward end pivotally connected to the platform and the platform is movable from a forward fully extended position wherein the control head is forward of the base to a rearward fully retracted position wherein the control head passes below and to a position rearward of the base.

29 Claims, 23 Drawing Sheets

(56) References Cited

U.S. PATENT DOCUMENTS

| | | | | |
|---|---|---|---|---|
| 6,488,248 | B1 * | 12/2002 | Watt | A47B 21/0314 108/138 |
| 6,523,797 | B2 | 2/2003 | LeClair et al. | |
| 6,565,055 | B1 | 5/2003 | Timm | |
| 6,601,812 | B2 | 8/2003 | LeClair et al. | |
| 6,883,764 | B1 * | 4/2005 | Mileos | A47B 21/0314 108/138 |
| 6,905,102 | B2 | 6/2005 | Lin | |
| 6,929,228 | B2 | 8/2005 | Whitaker et al. | |
| 6,971,624 | B2 | 12/2005 | Kollar et al. | |
| 7,188,813 | B2 | 3/2007 | Kollar | |
| 7,338,023 | B2 * | 3/2008 | Liu | A47B 21/0314 108/140 |
| 7,448,585 | B2 | 11/2008 | Skiba | |
| 7,455,270 | B2 | 11/2008 | Maloney et al. | |
| 7,523,905 | B2 * | 4/2009 | Timm | A47B 21/0314 108/138 |
| 7,533,859 | B2 | 5/2009 | Blackburn | |
| 7,891,631 | B2 * | 2/2011 | Lee | F16M 11/10 248/123.11 |
| 7,942,374 | B2 | 5/2011 | Timm et al. | |
| 8,272,608 | B2 | 9/2012 | Timm et al. | |
| 2007/0152122 | A1 | 7/2007 | Kirchhoff | |

* cited by examiner

SECTION C-C

SECTION C-C

ARTICULATING SUPPORT ARM

CROSS-REFERENCE TO RELATED APPLICATION

This application claims the benefit of U.S. Provisional Patent Application No. 61/928,816, filed Jan. 17, 2014, the disclosure of which is hereby incorporated by reference in its entirety.

FIELD OF THE DISCLOSURE

This disclosure is directed to articulating support arms that may be coupled to a workstation, such as to the lower surface of a tabletop or desktop, for use with a data entry/input device, such as a computer keyboard.

BACKGROUND

Various devices for supporting computer keyboards have been provided but they have not tended to provide a compact, high storage position under a workstation. Such a compact, high storage position may be needed, for example, when the workstation has a shallow depth from front to rear or includes an obstruction on the lower surface, such as a lateral support beam, which is common on some workstations, such as height adjustable tables.

SUMMARY

In a first aspect, the present disclosure provides an articulating support arm that includes a base, at least first and second links, a control head, and a platform. The first link has a forward end pivotally connected to the control head and a rearward end pivotally connected to the base. The second link has a forward end pivotally connected to the control head at a location spaced rearward of the connection of the forward end of the first link to the control head and has a rearward end pivotally connected to the base at a location spaced rearward of the connection of the rearward end of the first link to the base, wherein the pivotal connections of the base with the first and second links and the control head with the first and second links form a four bar linkage. The control head further has a forward end pivotally connected to the platform, and the platform is movable from a forward fully extended position wherein the control head is forward of the base to a rearward fully retracted position wherein the control head passes below and to a position rearward of the base.

In a second aspect, the present disclosure provides an articulating support arm having a locking assembly that holds a platform in a selected position at or between a forward fully extended position and a rearward fully retracted position.

In a third aspect, the present disclosure provides an articulating support arm having a platform that is pivotally connected to a control head wherein the platform includes an angled abutment that engages a slider extending between the abutment and a shaft that is rotatably connected to the control head, with the slider being rotatably connected to and driven by the shaft.

The disclosure provides preferred embodiments, as examples of configurations of articulating support arms that provide a compact design having a base that may be coupled to a workstation and that is able to achieve a compact, high storage position. It will be appreciated that with the present examples, the coupling to the lower surface of the workstation may be by direct connection of the workstation to the base of the articulating support arm, or by direct connection to a swivel plate that is pivotally connected to the base, or by direct connection to a track that is slidably connected to the base directly or via a swivel plate to which the base is connected.

However, prior art keyboard support arms typically simply allow a platform to be lowered by pivoting of one or more arms, and then moved rearward by sliding on a track. Yet, this may be unsuitable for use with some workstations, especially when the lower surface of the workstation has such a shallow depth from front to rear that it cannot accommodate a sliding track, or when there is an obstruction extending downward from a central portion of the lower surface of the workstation, such as may be present in the form of a lateral support beam. Such obstructions are more commonly found on certain types of workstations, such as height adjustable tables.

In such instances of shallow depth workstations or obstructions along the lower surface of a workstation, some prior art devices simply will not be able to be connected to the workstation, or will not permit the support arm to be moved rearward to a position beneath the workstation. Others may permit the support arm to be moved downward but would require the support arm to be so low to be able to clear the obstruction that that the support arm would prevent a user from being able to sit with the user's legs beneath the workstation. Others may be coupled to the workstation in such a wide configuration, that they are unable to pivot or swivel, to better accommodate the position of a user.

Each of the present articulating support arms provides a narrow, very compact configuration that is centered in front of the user and that may be extended forward and upward for use. It will be appreciated that a keyboard support tray or other more expansive work surface may be connected to the platform, so as to provide adequate surface area to support one or more data entry/input devices of different sizes.

Each example articulating support arm may, but need not be pivotally connected to the workstation, so as to swivel to the left or right, and may, but need not be slidably connected to a track to slide to a rearward fully retracted position that is sufficiently rearward to be completely below the lower surface of a workstation. Each example articulating support arm is movable to fold back on itself underneath the workstation when it pivots below its own base and continues to be moved upward to a high storage position. This compact, high storage configuration permits a user to sit with the user's legs comfortably beneath the fully retracted articulating support arm and workstation. Indeed, the first and second links pivot rearward beyond a lowermost position and are biased upward as they continue to move further rearward to a high storage position, with the capability of being located adjacent an obstruction extending downward from the lower surface of the workstation. Thus, it will be appreciated that, while such devices may be used with workstations having a flat lower surface, they also may be used to accommodate downward extending obstructions, such as a laterally extending beam or rail.

A locking assembly may include a locking link and wedge member that are activated by downward pivotal actuation of the forward edge of the platform, or by the force of the platform when it simply is released. Thus, a user's upward movement of the front edge of the platform causes the locking link that is pivotally connected to the platform to pull the wedge member forward and unlock the pivotal connection between the first link and the control head. Upon downward pivoting of the front of the platform, the locking link pushes the wedge member rearward, relocking the pivotal connection between the first link and the control head to achieve a fixed position of the articulating support arm that will be maintained until the front edge of the platform is pivoted upward. However, it will be appreciated that other locking assemblies could be utilized to hold the articulating support arm in a selected position at or between the forward fully extended and rearward fully retracted positions, whether including wedge members, braking, clamping or other suitable structures.

While the articulating support arm could be constructed with a fixed angle for the platform relative to a horizontal plane or to the base, it is preferable to provide for tilt adjustment of the platform. For instance, each of the preferred examples is shown with a platform that is pivotally connected to a control head wherein the platform includes an angled abutment that engages a slider extending between the abutment and a shaft that is rotatably connected to the control head, with the slider being rotatably connected to and driven by the shaft. A knob is connected to the shaft and as the knob and shaft are rotated, the slider is driven across the abutment surface, which, in turn, causes the angle or inclination of the platform relative to a horizontal plane or to the base to be adjusted. Yet, it will be appreciated that other components may be utilized to achieve and maintain tilt adjustment, such as clamping or locking mechanisms, or other suitable components.

These and other objects, advantages, and features of the disclosure will be set forth in the detailed description which follows.

BRIEF DESCRIPTION OF THE DRAWINGS

In describing the preferred examples, references are made to the accompanying drawing figures wherein like parts have like reference numerals, and wherein.

Figure 1:
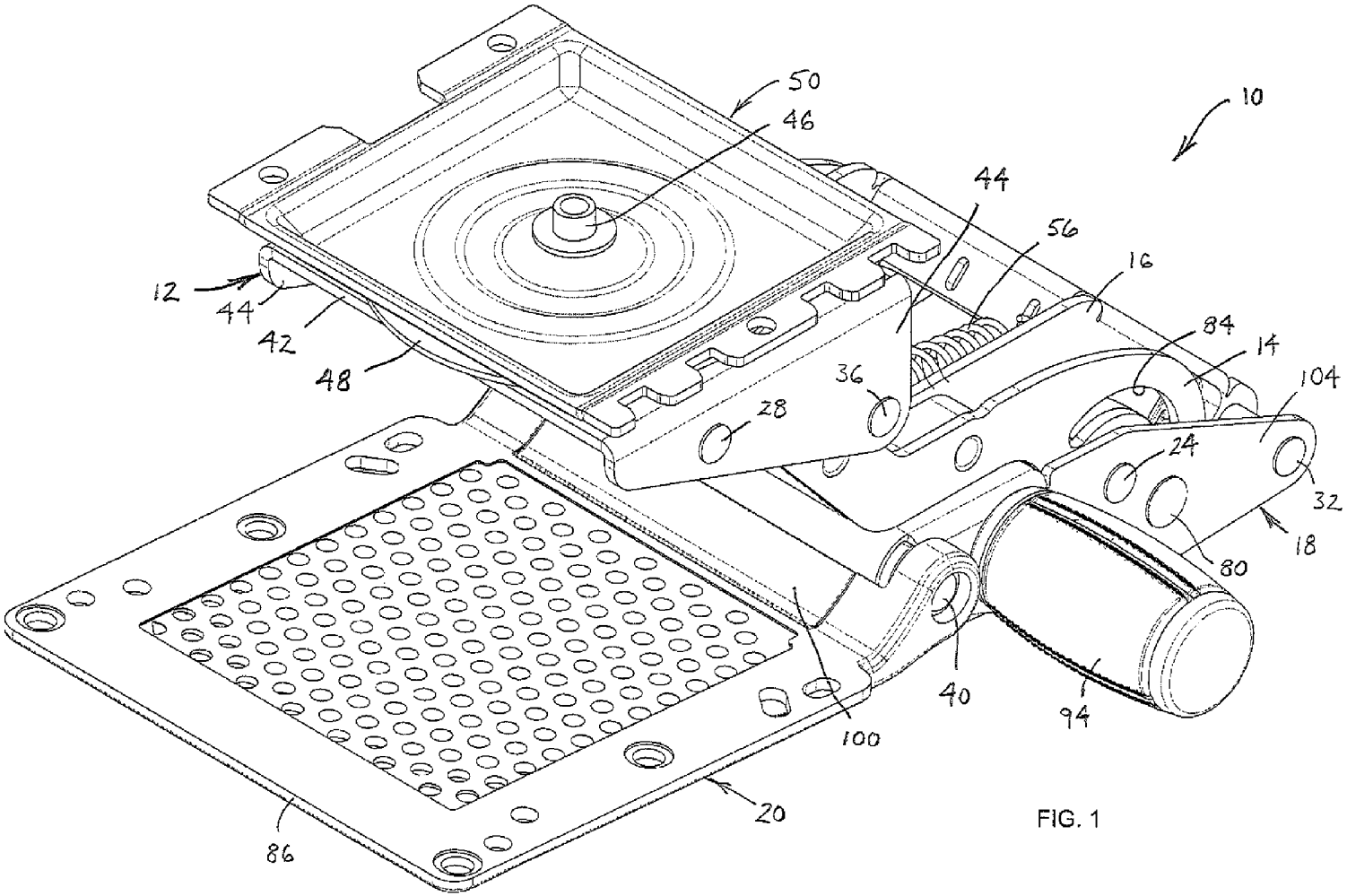
FIG. 1 is front upper perspective view of a first example embodiment of an articulating support arm in a rearward fully retracted position.

It should be understood that the drawings are not necessarily to scale. While some mechanical details of articulating support arms, including some details of fastening or connecting means and other plan and section views of the particular components, have been omitted, such details are considered within the comprehension of those skilled in the art in light of the present disclosure. It also should be understood that the present disclosure is not limited to the examples illustrated.

DETAILED DESCRIPTION

This disclosure presents examples of apparatus and methods of using the same, which may be embodied in several forms. For instance, within FIGS. 1-13B a first example articulating support arm is shown, as will be described further herein. A second example is shown in FIGS. 14-23, which uses somewhat similar components to those shown in FIGS. 11-13B but with additional height and tilt indicators, and will be described further herein. It will be appreciated, however, that the invention may be constructed and configured in various ways and is not limited to the examples disclosed in the form of the preferred embodiments shown and described herein.

A first example embodiment of an articulating support arm 10 is shown in several perspective and cross-section views within FIGS. 1-10. As may be seen in FIGS. 4 and 6, the articulating support arm 10 includes a base 12, at least first and second links 14, 16, a control head 18 and a platform 20. As will be described further herein, the at least first link 14, which in this example includes a pair of laterally spaced apart first links 14, has a forward end 22 (forward with respect to when the support arm is in a fully extended position) pivotally connected to the control head 18, and a rearward end 26 pivotally connected to the base 12. The at least second link 16, which in this example includes a pair of laterally spaced apart second links 16, has a forward end 30 pivotally connected to the control head 18 at a location spaced rearward of the connection of the forward end 22 of the first link 14 to the control head 18, and a rearward end 34 pivotally connected to the base 12 at a location spaced rearward of the connection of the rearward end 26 of the first link 14 to the base 12. It will be appreciated that each of the first and second links 14, 16 may be constructed in various ways, whether as multiple components connected together or as an integral component, as discussed further herein.

The platform 20 preferably is constructed of relatively rigid material, such as by being constructed of cast metal, sheet metal, fiber reinforced plastic, or the like. It also may be formed in one piece with apertures and flanges as needed for mounting of pivot pins, and it is contemplated that a keyboard support tray or other more expansive work surface may be connected to the platform for supporting one or more data entry/input devices.

The pivotal connection of forward end 22 of the first link 14 to the control head 18 is via a laterally extending pin 24, while the pivotal connection of the rearward end 26 of the first link 14 to the base 12 is via a laterally extending pin 28. Somewhat similarly, the pivotal connection of forward end 30 of the second link 16 to the control head 18 is via a laterally extending pin 32, while the pivotal connection of the rearward end 34 of the second link 16 to the base 12 is via a laterally extending pin 36.

Figure 2:
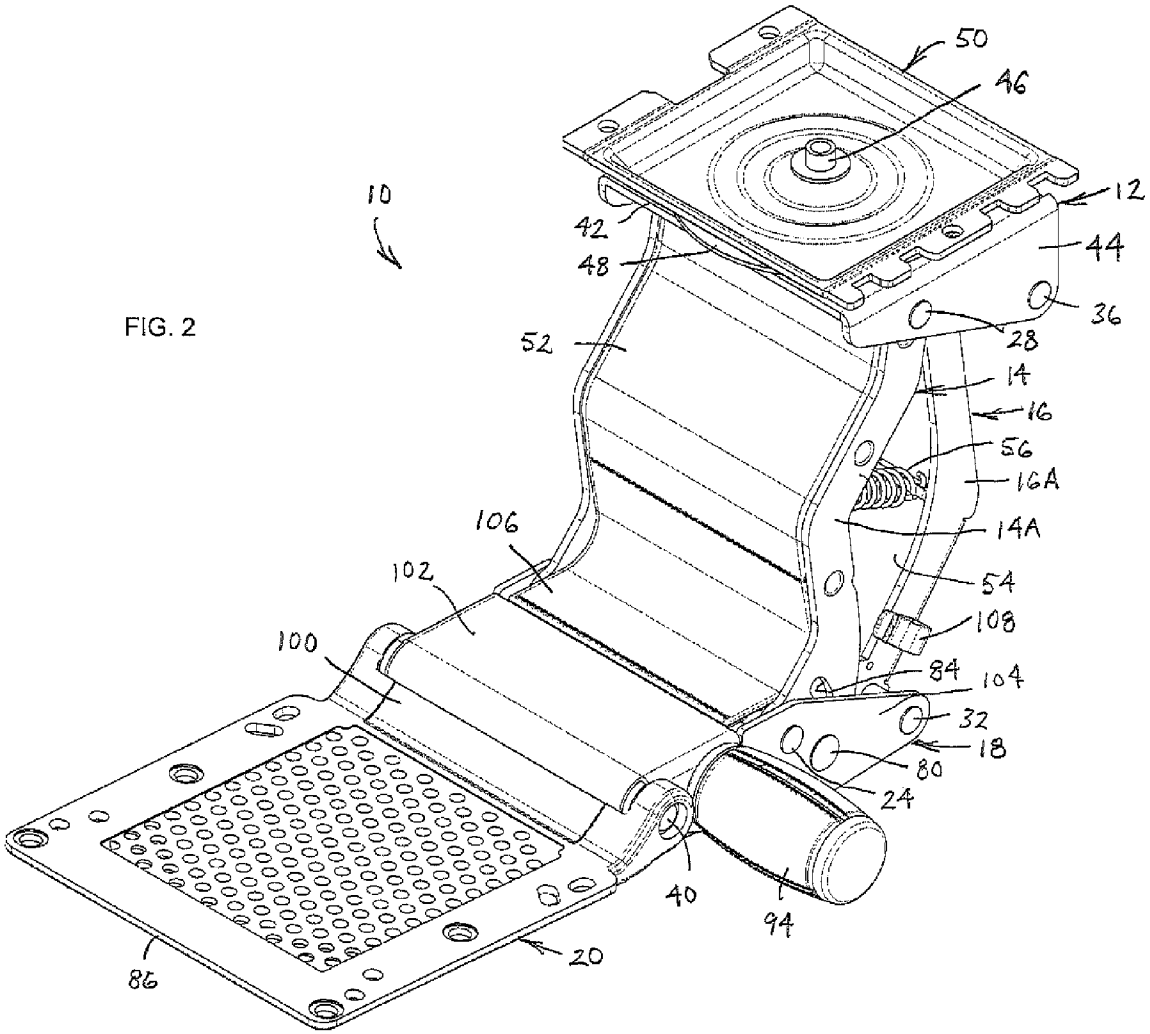
FIG. 2 is a front upper perspective view of the example articulating support arm shown in FIG. 1, in a position wherein the platform is at the bottom of the pivotal movement between the forward fully extended and rearward fully retracted positions.
Figure 3:
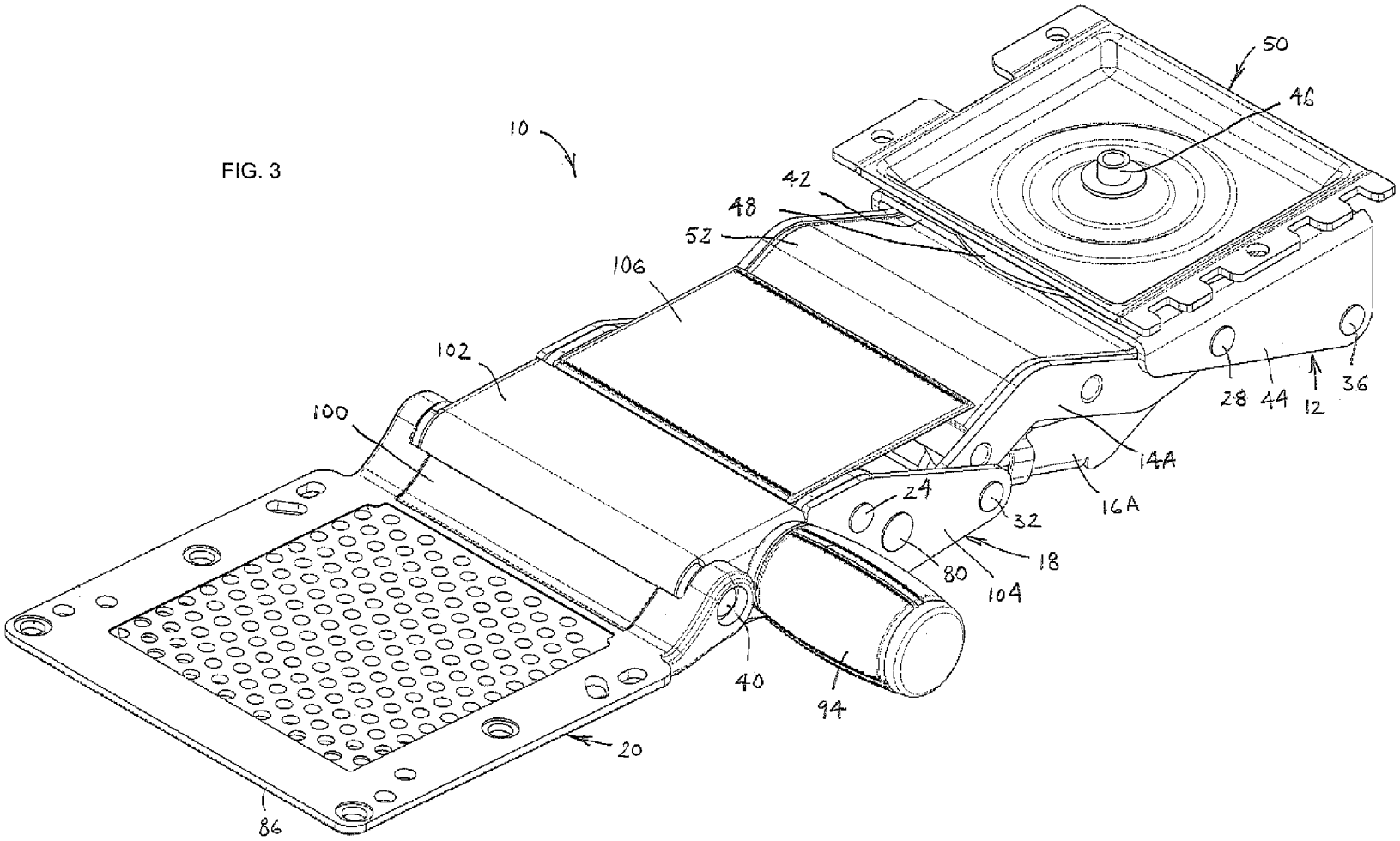
FIG. 3 is a front upper perspective view of the example articulating support arm shown in FIG. 1, in a forward fully extended position.
Figure 4:
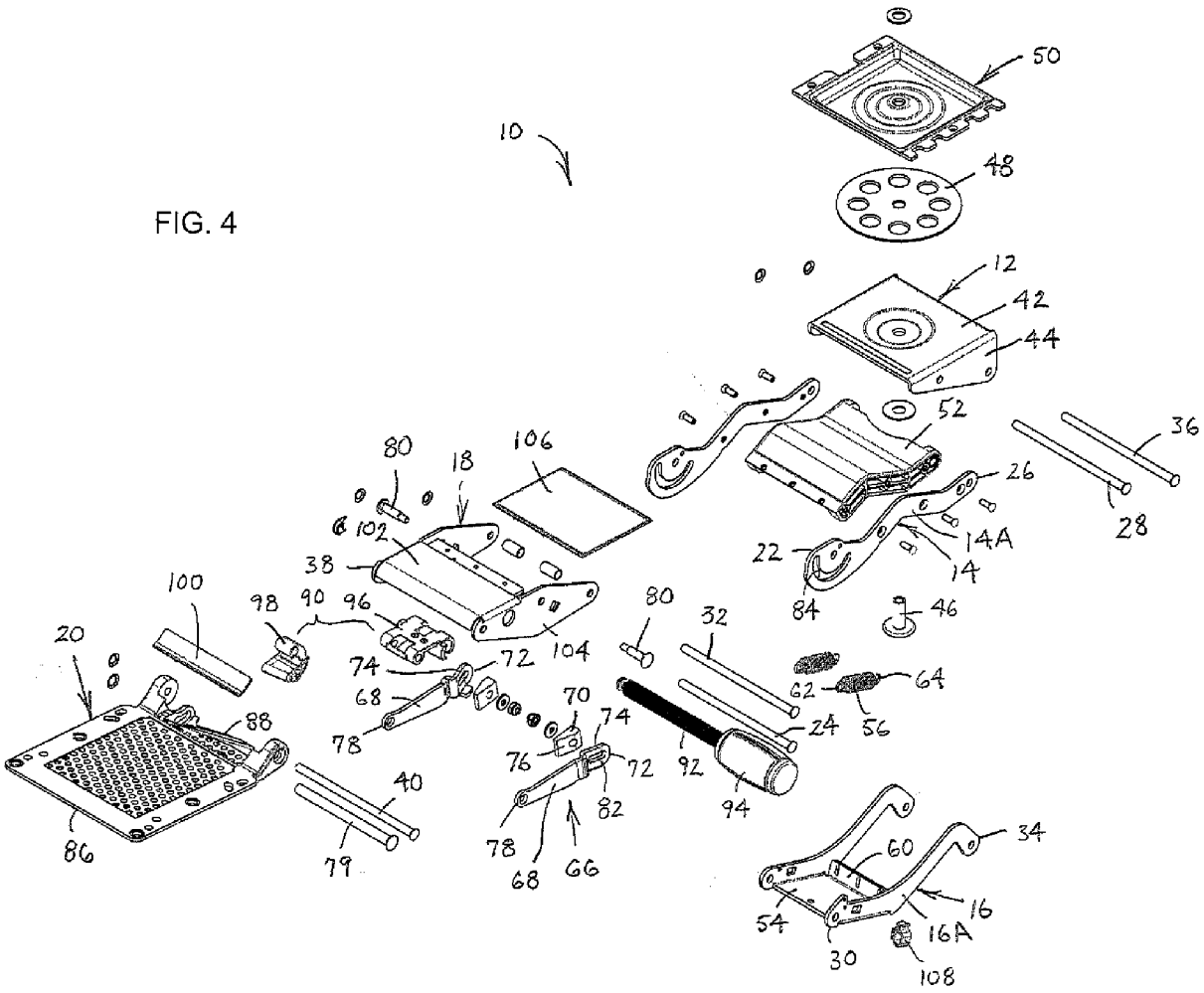
FIG. 4 is a front upper perspective exploded view of the example articulating support arm shown in FIG. 1.
Figure 5:
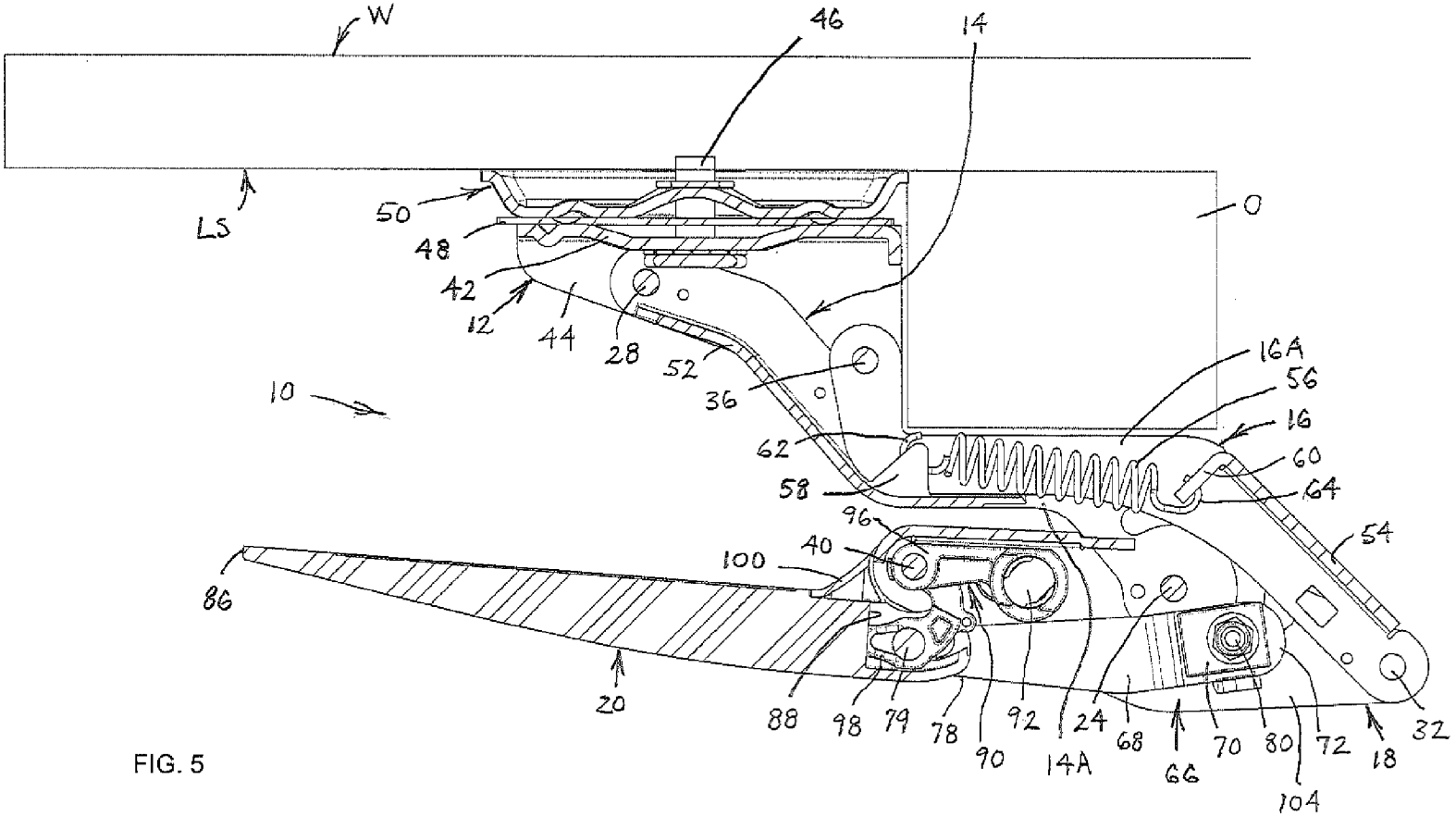
FIG. 5 is a cross-sectional side view of the example articulating support arm shown in FIG. 1, in a rearward fully retracted position below a workstation having an obstruction in the form of a support beam extending downward from the lower surface of the workstation.
Figure 6:
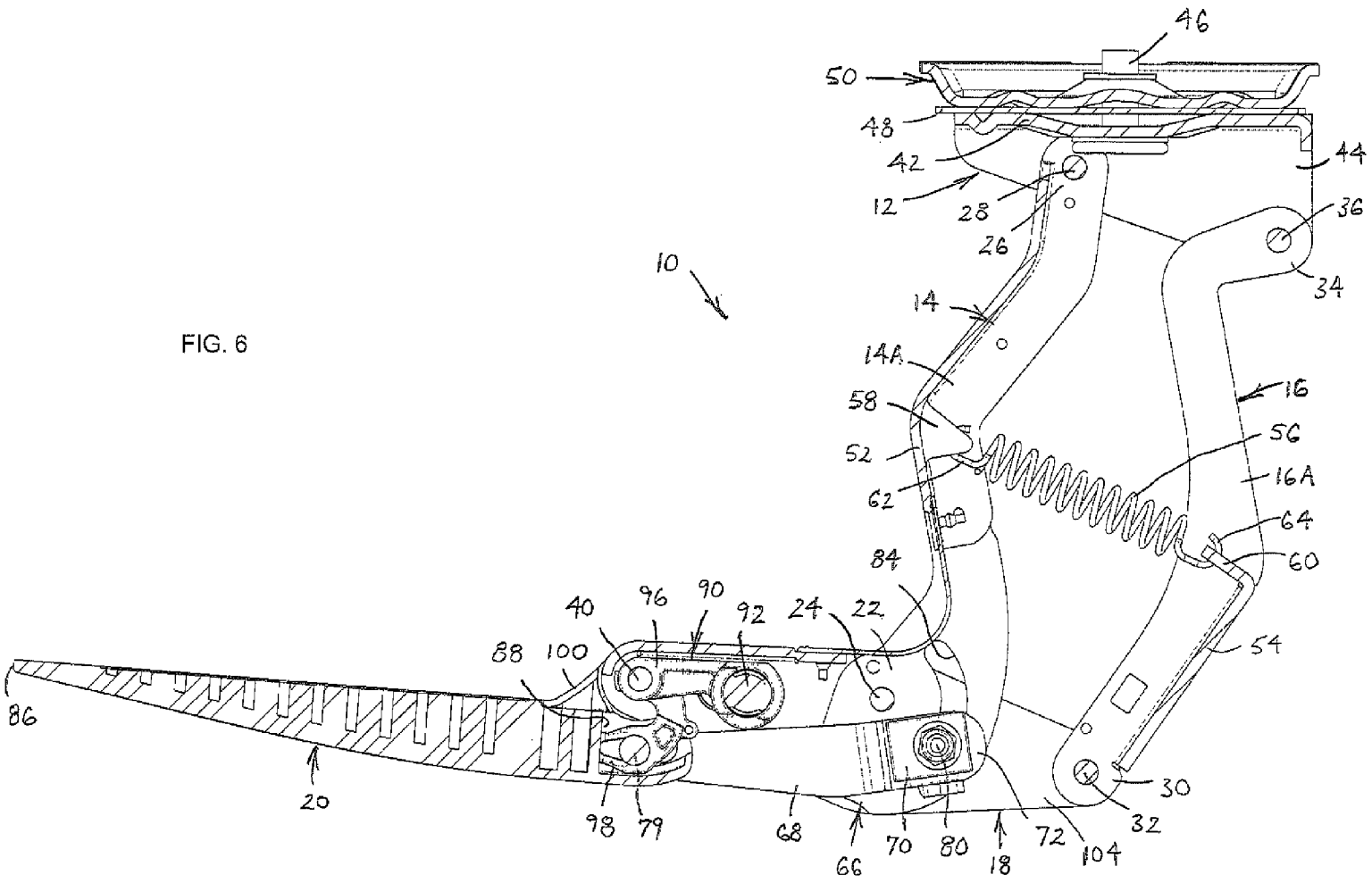
FIG. 6 is a cross-sectional side view of the example articulating support arm shown in FIG. 1, in a position wherein the platform is at the bottom of the pivotal movement between the forward fully extended and rearward fully retracted positions.
Figure 7:
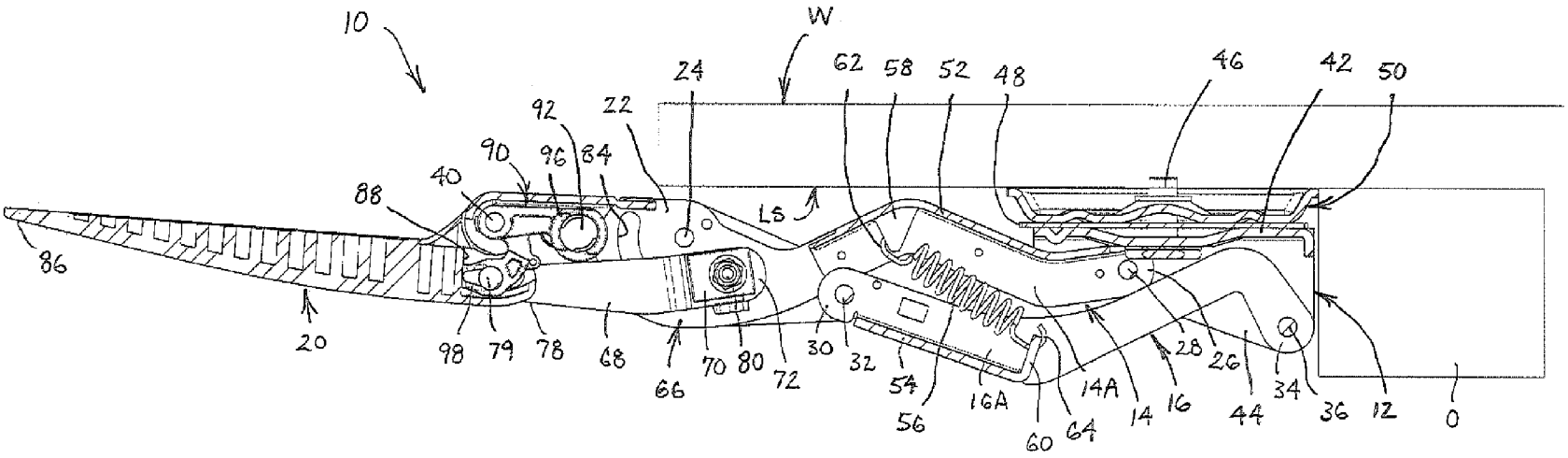
FIG. 7 is a cross-sectional side view of the example articulating support arm shown in FIG. 1, in a forward fully extended position.
Figure 8:
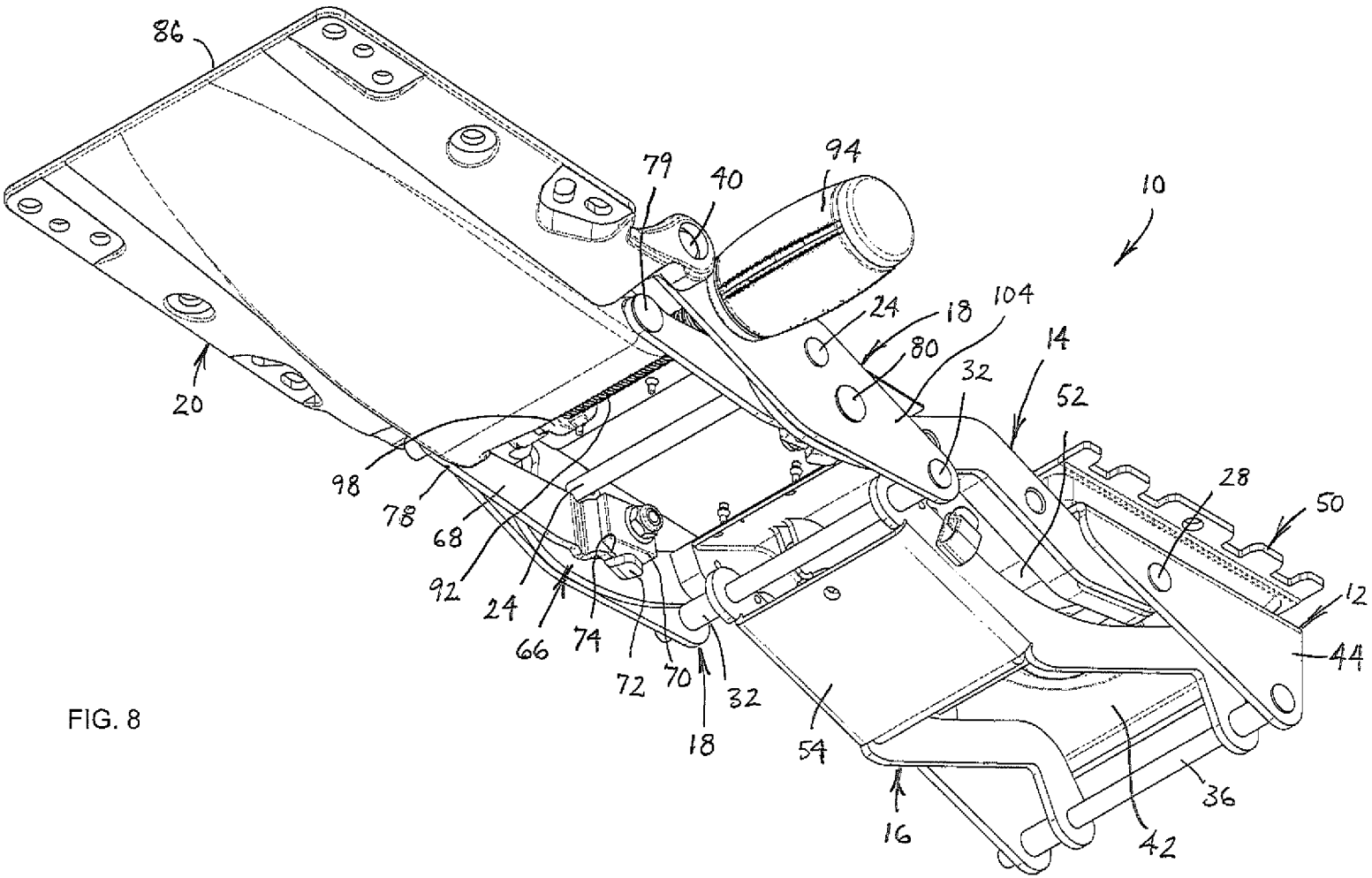
FIG. 8 is a front lower perspective view of the example articulating support arm shown in FIG. 1, in a forward fully extended position.
Figure 9:
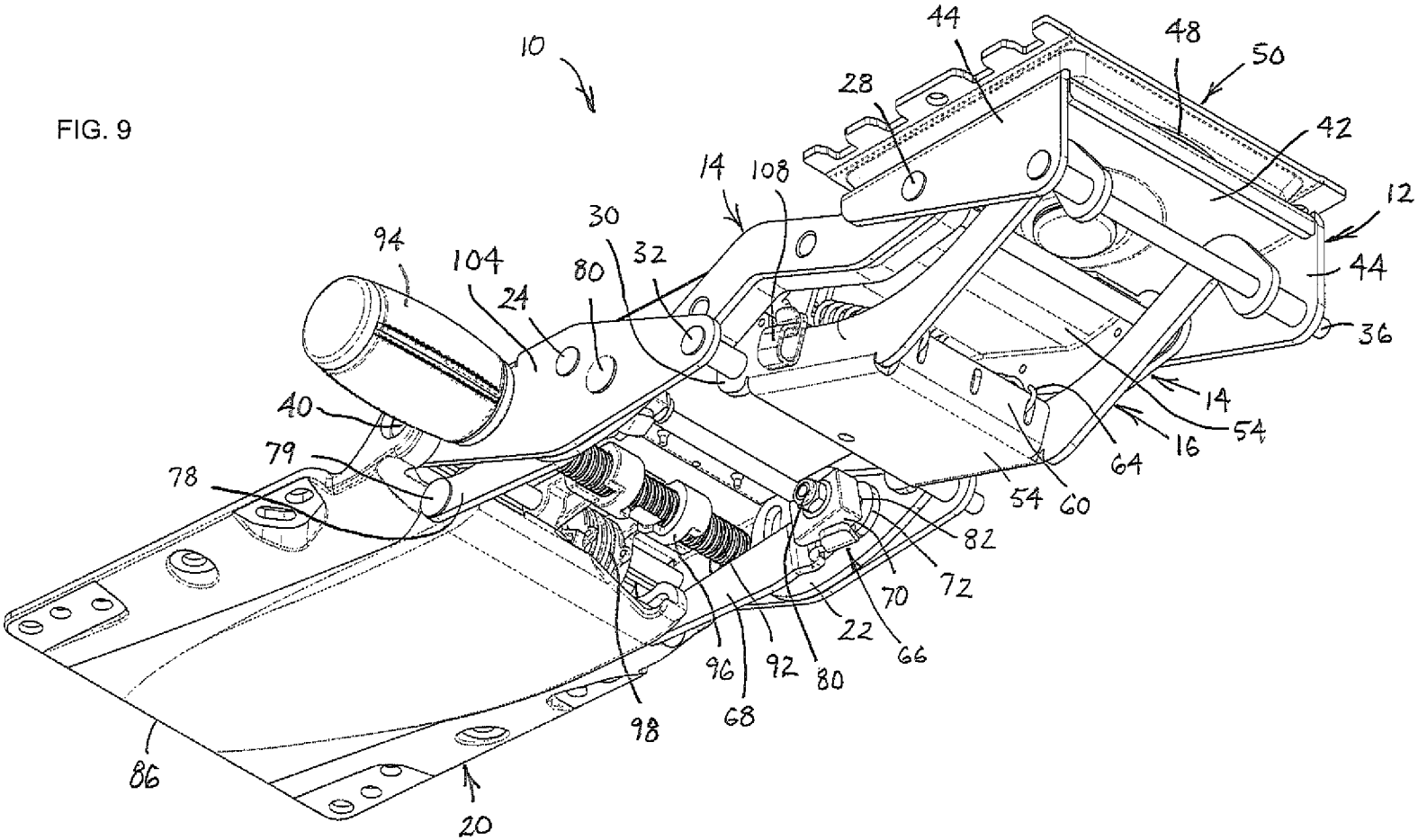
FIG. 9 is a rear lower perspective view of the example articulating support arm shown in FIG. 1, in a forward fully extended position.
Figure 10:
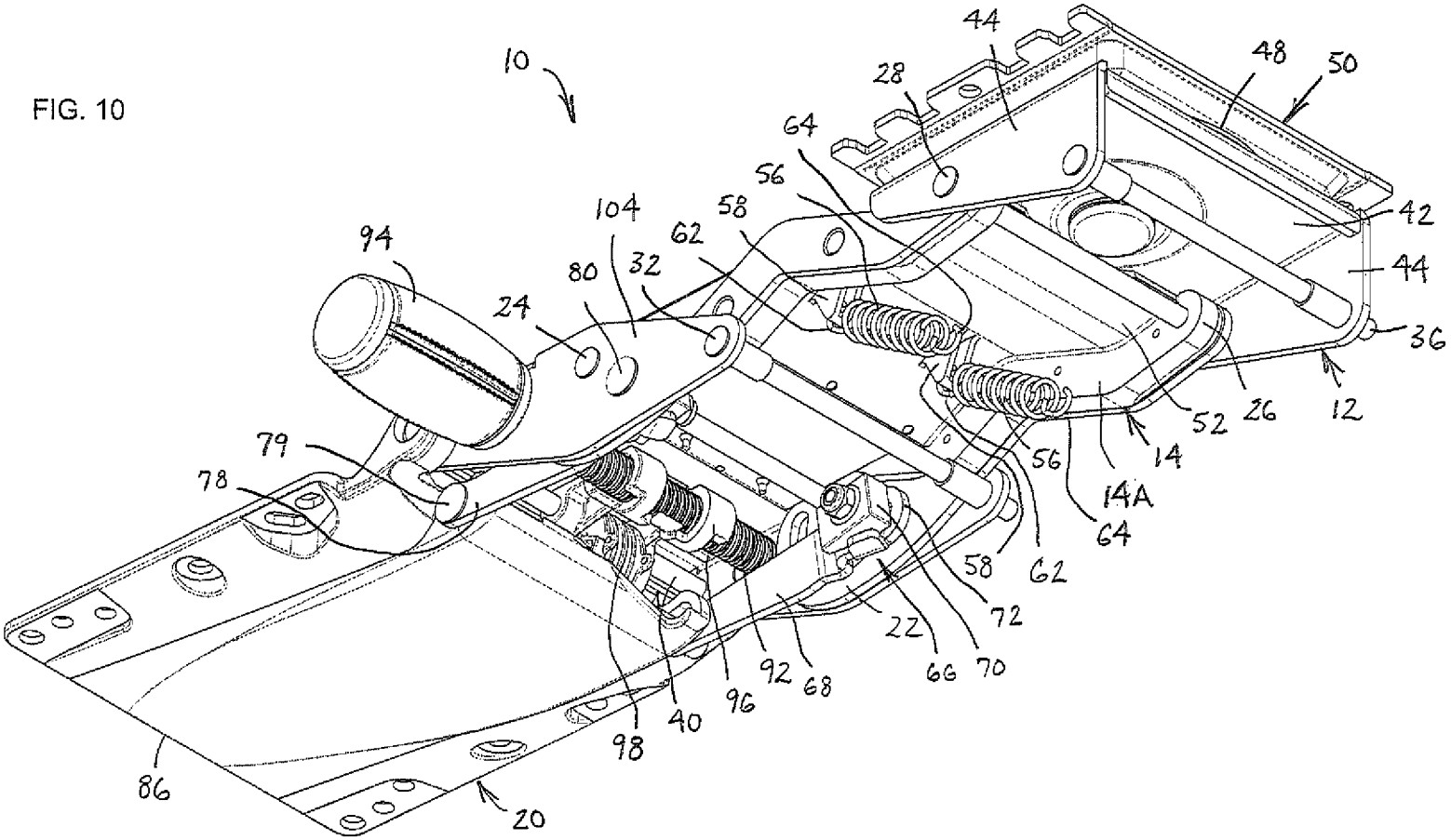
FIG. 10 is a rear lower perspective view of the example articulating support arm shown in FIG. 1, in a forward fully extended position and having the second link removed to permit viewing of the coupling of the resilient members to the first link.
Figure 11:
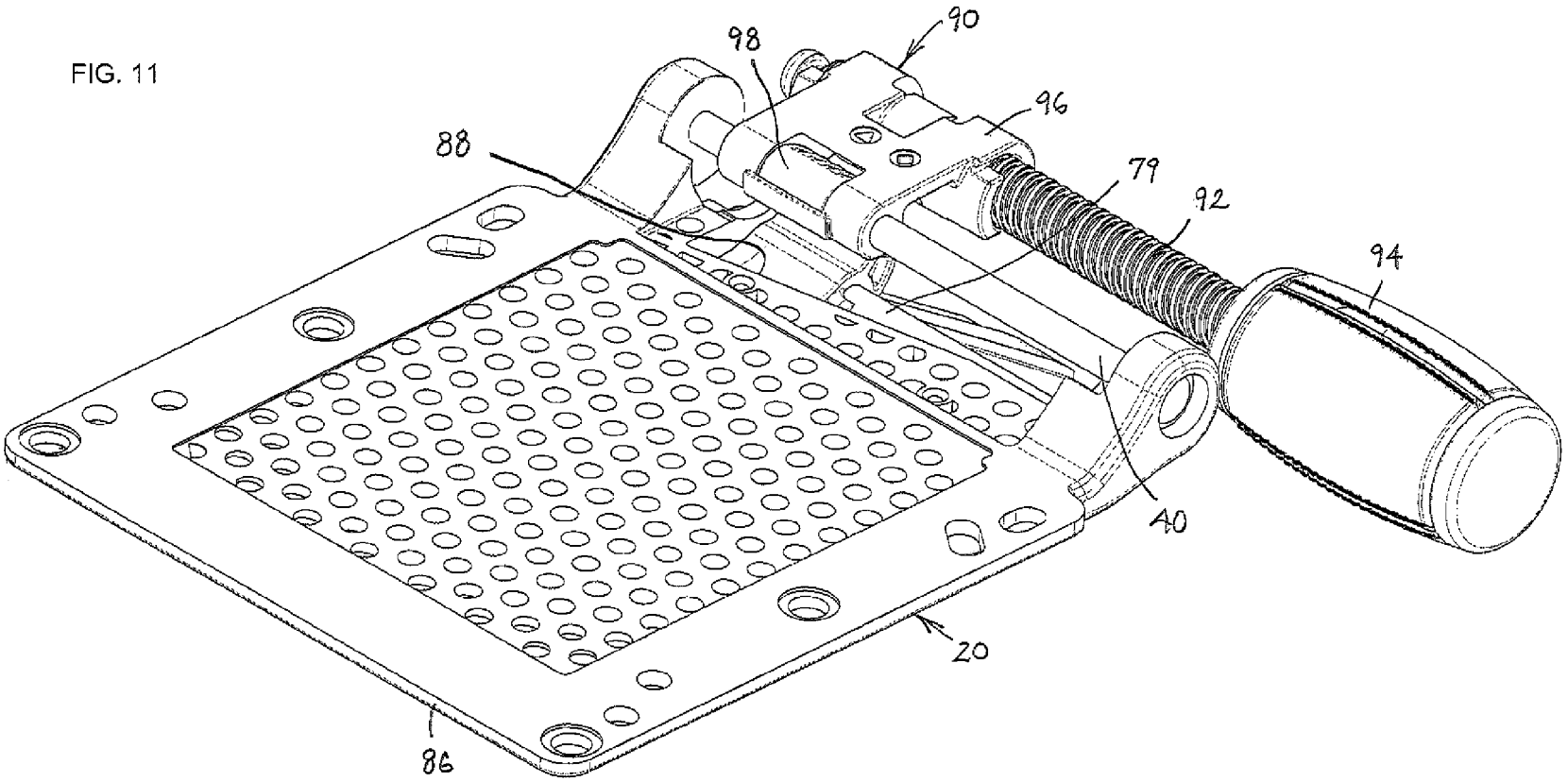
FIG. 11 is front upper perspective view of the platform, tilt adjustment slider and shaft of the first example articulating support arm shown in FIG. 1.
Figure 12A:
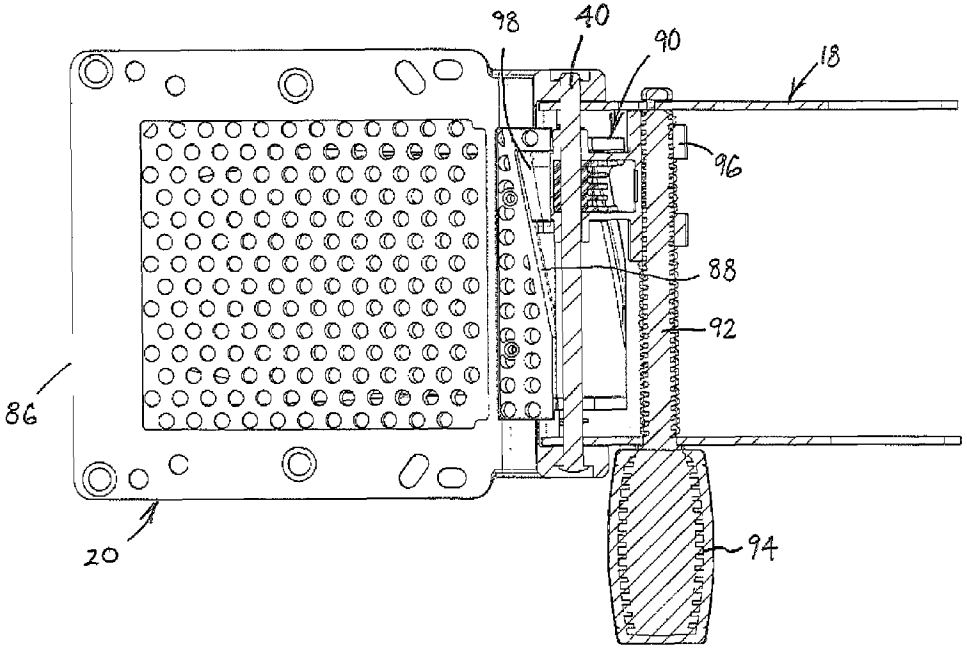
FIG. 12A is cross-sectional top view of the control head, platform, slider and shaft of the first example articulating support arm shown in FIG. 1, with the cross-section taken through the section line C-C shown in FIG. 12B with the slider at the extreme left position and the front edge of the platform at its lowest position relative to the rear edge of the platform.
Figure 12B:
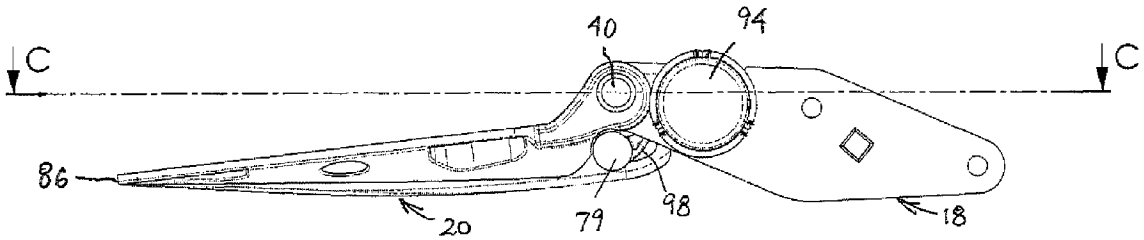
FIG. 12B is a side view of the control head, platform, slider and shaft of the first example articulating support arm shown in FIG. 1, having a section line C-C associated with the cross-sectional view shown in FIG. 12A while the front edge of the platform at its lowest position relative to the rear edge of the platform.
Figure 13A:
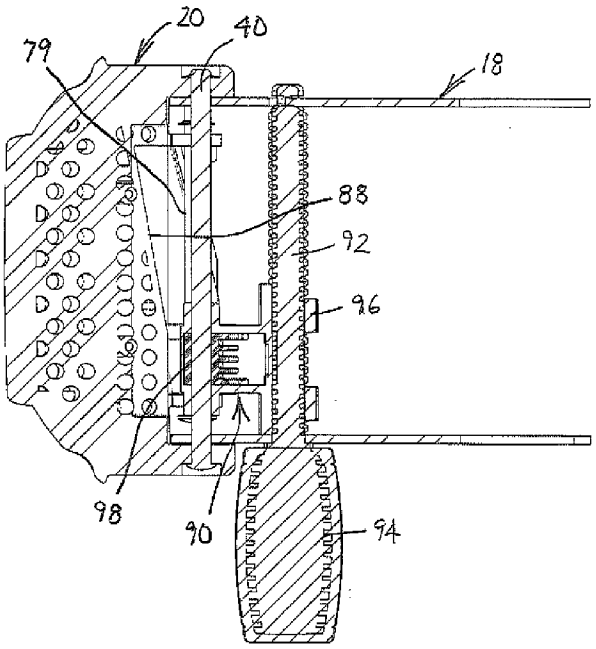
FIG. 13A is cross-sectional top view of the control head, platform, slider and shaft of the first example articulating support arm shown in FIG. 1, with the cross-section taken through the section line C-C shown in FIG. 13B with the slider at the extreme right position and the front edge of the platform at its highest position relative to the rear edge of the platform.
Figure 13B:
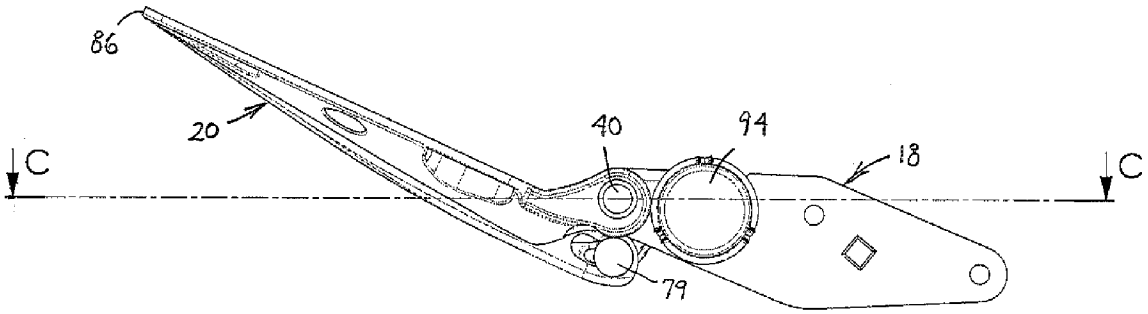
FIG. 13B is a side view of the control head, platform, slider and shaft of the first example articulating support arm shown in FIG. 1, having a section line C-C associated with the cross-sectional view shown in FIG. 13A while the front edge of the platform at its highest position relative to the rear edge of the platform.
Figure 14:
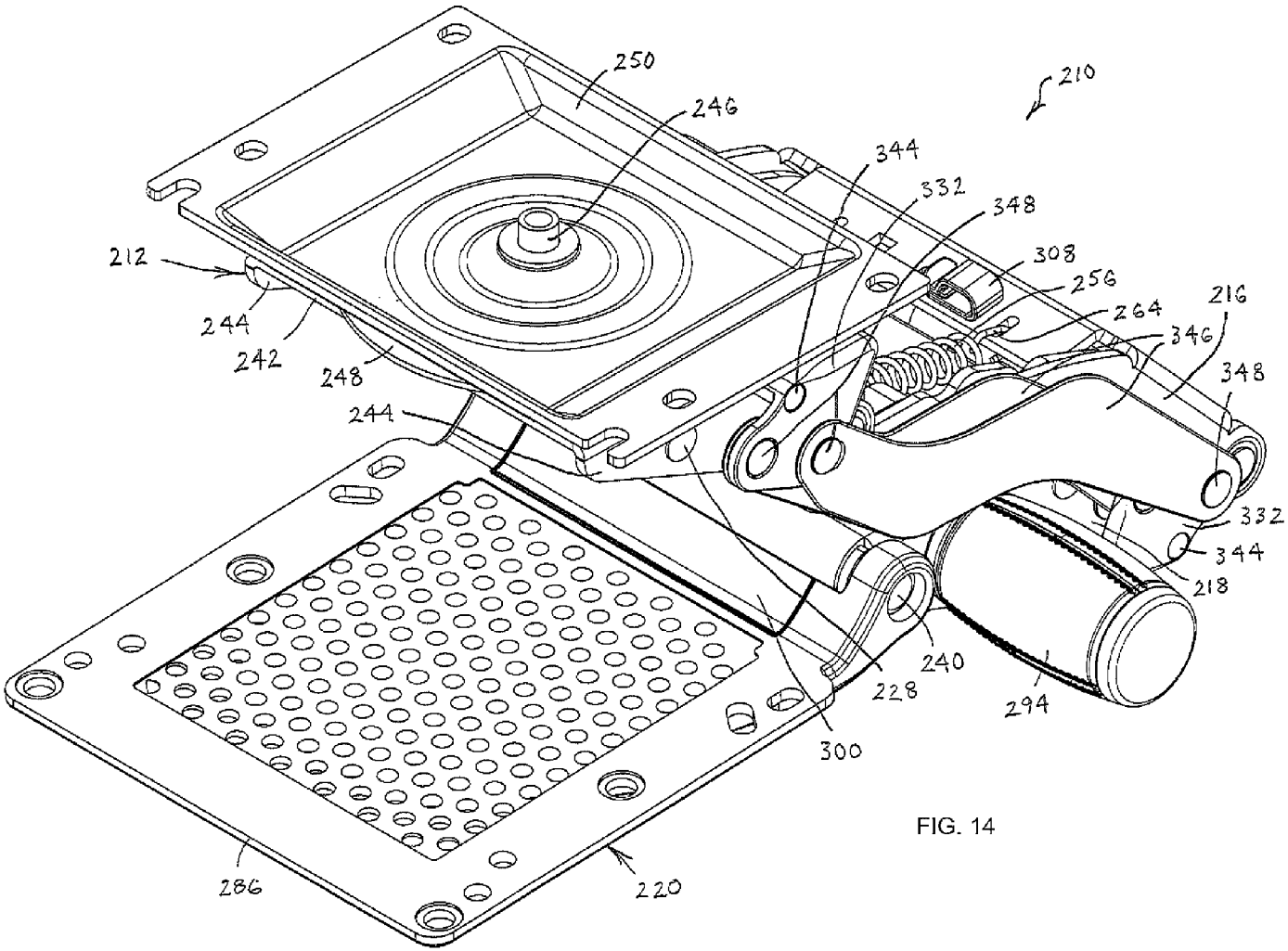
FIG. 14 is front upper perspective view of a second example embodiment of an articulating support arm in a rearward fully retracted position and having a platform, tilt adjustment slider and shaft similar to that of the first example but incorporating additional height and tilt indicators.

It will be appreciated that the pivotal connections among the base 12, the first and second links 14, 16 and the control head 18, via the generally parallel pins 28, 36, 24, 32, form a four bar linkage. The first and second links 14, 16 each have a non-linear configuration or shape, which permits the pivotal connections of the second link 16 to the base 12 and control head 18 to be spaced rearward of the pivotal connections of the first link 14 to these components, and result in a four bar linkage having a quite shallow configuration. This can be seen for instance in FIGS. 3 and 7 with the articulating support arm 10 in a forward fully extended position. Indeed, central portions 14A, 16A of the first and second links 14, 16 are quite close together when the articulating support arm 10 is in the forward fully extended position, are quite close together and include portions that are parallel and in a generally horizontal orientation when in the rearward fully retracted position shown in FIGS. 1 and 5, and have their central portions 14A, 16A furthest apart when in an intermediate position, such as is shown in FIGS. 2 and 6. As can be appreciated when viewing FIGS. 1-3 and 5-7, by utilizing the four bar linkage, the platform 20 has the same orientation relative to a horizontal plane when in the forward fully extended position and after being moved to the rearward fully retracted position. Thus, the articulating support arm 10 may be adjusted vertically, without changing the tilt angle or orientation of the platform 20.

The control head 18 has a forward end 38 pivotally connected to the platform 20. This pivotal connection is achieved with a laterally extending pin 40. With this configuration, the platform 20 is movable from a forward fully extended position, which may be seen in FIGS. 3 and 7-10, wherein the control head 18 is forward of the base 12, to a rearward fully retracted position, which may be seen in FIGS. 1 and 5, wherein the control head 18 passes below and to a position rearward of the base 12. It will be appreciated that the first and second links 14, 16 extend forward from the base 12 when the platform 20 is in the forward fully extended position and extend rearward from the base 12 when the platform is in the rearward fully retracted position.

Additional FIGS. 2 and 6 are provided to show the relative positioning of the first and second links 14, 16 when in a further location, which may be an intermediate position during movement of the articulating support arm 10 between the forward fully extended and rearward fully retracted positions wherein the control head 18 is passing below the base 12, or potentially could be a stationary lowered position for use, as the platform 20 is forward of the base 12.

In this first example, the base 12 of the articulating support arm 10 is in the form of a clevis, which may be constructed of any suitable relatively rigid materials, such as cast metal, sheet metal, molded plastics, or the like. Thus, the base 12 has a U-shape that includes a body 42 and downward extending side walls 44 having apertures for receipt of pins 28, 36. The body 42 is pivotally connected by an axle 46 and a bearing 48 to a swivel plate 50.

It will be appreciated that the base 12 is configured to be coupled to a workstation, which may be in various forms, such as a table, desk, shelf, credenza or the like. This is represented schematically, for example, in FIGS. 5 and 7, where a workstation W is in the form of a table having a tabletop. The tabletop of the workstation W has a lower surface LS, from which an obstruction O extends downwardly, where the obstruction O is represented as a laterally extending support beam. With respect to coupling to the workstation W, if it is desired that the articulating support arm 10 only be movable in a path directly forward and rearward and via the pivotal connections of the base 12, first and second links 14, 16 and control head 18, then the base 12 may be coupled to the workstation by connecting the body 42 directly to the lower surface LS of the workstation W, such as by use of screws extending through appropriately drilled holes in the body 42, or by use of other suitable connecting structures. However, if it is desired that the articulating support arm 10 also be able to swivel or pivot to the left or right, then it may be coupled to the workstation W by pivotally connecting the base 12 to the swivel plate 50 and then directly connecting the swivel plate 50 to the lower surface LS of the workstation W. Alternatively, if space permits, there are not obstructions and it is desired to provide further fore and aft movement, then the base 12 may be coupled to the workstation W by directly connecting a track to the lower surface LS of the workstation W in a conventional manner, such as by screws or other connecting structures, and slidably connecting the base 12 and/or swivel plate 50 to the track, so as to also be able to extend the reach or total distance which the articulating support arm 10 may travel between a forward fully extended position and a rearward fully retracted position. Thus, as seen in FIG. 5, when the base 12 is coupled to a lower surface LS of a workstation W and the platform 20 is moved to the rearward fully retracted position, the non-linear configuration of the first and second links 14, 16 provides space above the first and second links 14, 16 to accommodate an obstruction O on the lower surface LS of the workstation W.

The first links 14 are shown as being connected to and by an upper body 52 that spans between them. Somewhat similarly, the second links 16 are shown as being connected to and by a lower body 54. It will be appreciated that the upper and lower bodies 52, 54 are optional and may be separate pieces that are connected by fasteners, such as is shown with upper body 52, or by other suitable means of connections, such as by welding or the like, or may be integrally formed with the links, such as is shown with lower body 54. Thus, the first and second links 14, 16 may be constructed of separate parallel components and may include a lateral portion, whether constructed as an assembly or as an integral component. As such, the components within the first and second links and the upper and lower bodies may be constructed of relatively rigid materials, such as cast metal, sheet metal, molded plastics, or the like. The upper and lower bodies 52, 54 have at least three functions in that they act as shrouds to provide a cleaner, more pleasing product appearance, cover much of the mechanical structures that might otherwise present pinch points, and provide connection points for coupling one or more resilient members 56 to the first and second links 14, 16.

In this first example, as may be seen in FIGS. 5-7 and 9-10, the underside of the upper body 52 includes holding elements in the form of projections 58 that extend toward the lower body 54, while the lower body 54 includes a second holding element 60 in the form of a flange that extends toward the upper body 52. The resilient member 56 is shown as a spring that includes first and second ends 62, 64 and a coiled central portion by which it may provide tension when the first and second ends 62, 64 are moved away from each other. The holding elements 58, 60 provide apertures that are in opposed locations, such that an aperture in a holding element 58 receives a first end 62 of a resilient member 56 while an aperture in the opposed holding element 60 receives a second end 64 of the same resilient member 56. Having a resilient member 56 coupled to the first and second links 14, 16 tends to bias the support arm to move upward toward the forward fully extended position or toward the rearward fully retracted position. This may be helpful to a user when moving and effectively lifting to a position for use or to be stowed, and may help avoid a sudden downward drop when the articulating support arm 10 is unlocked to permit movement.

With respect to locking, the articulating support arm 10 includes a locking assembly 66 that holds the support arm, and therefore the platform 20, in a selected position at or between the forward fully extended position and the rearward fully retracted position. The locking assembly 66 includes at least one locking link 68 and at least one wedge member 70. The locking link 68 has a rearward end 72, and the rearward end 72 of the locking link 68 and the wedge member 70 have respective opposed complementary angled surfaces 74, 76 that slidably engage each other. The locking link 68 has a forward end 78 pivotally connected to the platform 20 at a pin 79 and the rearward end 72 is pivotally connected to the control head 18 and to the first link 14. The pivotal connection of the rearward end 72 of the locking link 68 to the control head 18 includes a pivot shaft or pin 80 that extends through the wedge member 70, the locking link 68, the first link 14 and the control head 18, and that includes a head, nut or other suitable means at each end to capture within the length of the pin 80 the components that may move axially along its captured length. Thus, the pivot pin 80 extends through an aperture in the wedge member 70, a linear slot 82 in the rearward end 72 of the locking link 68, and through an arcuate slot 84 in the forward end 22 of the first link 14, and the captured length of the pin 80 may be a length that is somewhere between the minimum and maximum thickness or axial dimension of the combined aforementioned components through which the pin 80 extends, while also accounting for any washers or other less significant components therebetween. The arcuate slot 84 permits the pin 80 to move or slide therein as the first link 14 pivots relative to the control head 18, when the locking assembly 66 is unlocked.

It will be appreciated that the locking assembly 66 of the articulating support arm 10 may be easily and conveniently unlocked. When a forward edge 86 of the platform 20 is tilted upward, pivoting about the pin 40, the locking link 68 that is pivotally connected to the platform 20 at the pin 79 is moved forward relative to the control head 18, and therefore, pulls the wedge member 70 forward. This unlocks the pivotal connection of the control head 18 to the first link 14 wherein the articulating support arm 10 may then be move to a selected position at or between the forward fully extended position and the rearward fully retracted position. Thus, when the wedge member 70 is pulled forward and its angled surface 76 slides relative to the angled surface 74 of the locking link 68, the combined thickness of the components of the locking assembly 66 decreases and the locking assembly 66 is decompressed, removing the compression between the surfaces of the first link 14 and the control head 18 that otherwise effectively locked them due to the increased friction caused by the compression that is present when the platform 20 is released and the articulating support arm 10 is at rest in a selected position.

Hence, by tilting the forward edge 86 of the platform 20 upward, the effective compression lock is removed and the components of the four bar linkage are permitted to pivot relative to each other, wherein the position of articulating support arm 10 may be adjusted by moving the platform 20 to a new selected position at or between the forward fully extended position and the rearward fully retracted position. Once the desired position is reached, the platform 20 may be released and the downward force associated with the rest position will cause the locking link 68 to move the wedge member 70 back into a position to compress the components of the locking assembly 66, thereby locking the articulating support arm 10 in the desired position. Accordingly, to a user, the locking assembly 66 provides intuitive, simple, one-handed operation, without any need to see the operation of the components that are unlocking or locking. Additional benefits include the lack of use of cables or other components that may require readjustment as they wear. The wedge member 70 preferably is relatively rigid and may be constructed of any suitable relatively rigid materials, such as cast metal, sheet metal, molded plastics, or the like. Indeed, as the wedge member 70 wears, the locking assembly 66 is effectively self-adjusting because the angled surfaces 74, 76 will move over each other until the combined thickness of the portions of the locking link 68 and wedge member 70 are sufficient to bind or lock the first link 14 relative to the control head 18.

It will be noted that additional advantages may be provided if the wedge member 70 is constructed of a plastic material, such as to promote smooth sliding, quiet operation and a relatively inexpensive wear part, if the wedge member 70 should ever need to be replaced. As noted previously, the four bar linkage within the articulating support arm 10 allows unlocking of the locking assembly 66 and a height adjustment of the support arm 10 while essentially retaining the same orientation of the platform 20 relative to a horizontal plane. The arcuate slot 84 in the forward end 22 of the first link 14 allows the articulating support arm 10 to pivot or be moved through an extensive angular range of motion, which if desired may be as much as 120-140 degrees. This is unlike known devices which do not tend to have a configuration that would permit a significant portion of a support arm to pass below and rearward of a base, and therefore, tend to have angular travel of no more than 90 degrees.

As previously noted, while an articulating support arm may be constructed with a preset orientation of the platform relative to a horizontal plane, with such preset orientation being maintained throughout the height adjustment of the articulating support arm, the example shown also provides for adjustment of the orientation of the platform 20 relative to a horizontal plane, which may otherwise be referred to as tilt adjustment of the platform 20. As shown, the platform 20 includes an angled abutment 88 that engages a slider 90 extending between the angled abutment 88 and a shaft 92 that is rotatably connected to the control head 18. The slider 90 is rotatably connected to and driven by the shaft 92. In this first example, this driving motion is achieved by having the shaft 92 and the slider 90 have corresponding screw threads thereon to cause the slider 90 to move along the shaft 92 when the shaft 92 is rotated. The shaft 92 has a knob 94 fixedly connected to one end to permit a user to quickly and easily rotate the shaft 90 to perform a tilt adjustment, thereby changing the pitch or angle of inclination of the platform 20.

While the slider 90 could be constructed of a single piece, but in the example shown, as may be seen in FIGS. 4-7 and 11-13B, the slider 90 is if two-piece construction, having an upper portion 96 that engages the shaft 92 and a lower portion 98 that engages the angled abutment 88 on the platform 20. Thus, the lower portion 98 of the slider 90 and the angled abutment 88 have complementary angled surfaces that slidably engage each other and cause the platform 20 to tilt as the slider 90 moves along the shaft 92. In this configuration, the platform 20 is pivotally connected to the control head 18 by the pin 40 that is parallel to the shaft 92. Further, the slider upper portion 96 engages the shaft 92, and to keep from rotating with the shaft 92 the slider upper portion 96 also slidably engages the pin 40. In the configuration shown, the slider upper portion 96 includes a U-shape which straddles and engages the slider lower portion 98 at their slidable connection to the pin 40. When the knob 94 is turned, the slider lower portion 98 is pushed toward one side or the other by the slider upper portion 96 and to maintain its orientation relative to the angled abutment 88, the slider lower portion 98 slidably engages the pin 79, as well as the pin 40. FIGS. 12A-13B are particularly useful in showing the relative positioning of the slider 90 on the angled abutment 88 and the resulting range of tilt adjustment when the knob 94 and shaft 92 are rotated from one extreme to the other. It will be appreciated that the slider 90 preferably is constructed of relatively rigid materials, such as cast metal, molded plastics, or the like.

During assembly, the slider 90 may be installed on the pin 40 that pivotally connects the control head 18 to the platform 20. Thus, the slider 90 need not be installed on the platform 20 but simply engages the angled abutment 88. In this first example, the angled abutment 88 is integral with the platform 20. This can be very efficiently achieved during manufacture of the platform 20. Alternatively, a separate angled component could be connected to the rear of the platform 20 to be engaged by the slider 90. It will be appreciated that, in a further alternative, the angled abutment 88 could be configured so that the slider 90 is slidably connected to the angled abutment 88, such as within a channel, as opposed to simply slidably contacting a surface of the angled abutment 88.

With the first example shown and described above, the articulating arm 10 may be adjusted to position the platform 20 for use or stowage below a workstation, and the tilt adjustment or orientation of the platform 20 relative to a horizontal plane may be separately adjusted, if desired. The articulating support arm 10 may include further components to enhance the appearance and safety of the device, such as a front shroud 100 to cover the tilt adjustment assembly, a shroud 102 that is integrally formed with the control head 18 as it spans between two side walls 104, a cover 106 that closes the area between the shroud 102 and the upper body 52, and a cable management clip 108 to hold one or more cables that may be associated with a data entry/input device. These components, as well as the control head 18, may be constructed of suitable materials, such as cast metal, sheet metal, molded plastics, or the like.

Turning now to a second example embodiment of an articulating support arm 210, which is shown in several perspective and cross-section views within FIGS. 14-23, and which uses somewhat similar components to those shown in FIGS. 11-13B, but incorporating height and tilt indicators. As may be seen in FIGS. 17 and 19, the articulating support arm 210 includes a base 212, at least first and second links 214, 216, a control head 218 and a platform 220. As will be described further herein, the at least first link 214, which in this example includes a pair of laterally spaced apart first links 214, has a forward end 222 (forward with respect to when the support arm is in a fully extended position) pivotally connected to the control head 218, and a rearward end 226 pivotally connected to the base 212. The at least second link 216, which in this second example includes a pair of laterally spaced apart second links 216, has a forward end 230 pivotally connected to the control head 218 at a location spaced rearward of the connection of the forward end 222 of the first link 214 to the control head 218, and a rearward end 234 pivotally connected to the base 212 at a location spaced rearward of the connection of the rearward end 226 of the first link 214 to the base 212. It will be appreciated that each of the first and second links 214, 216 may be constructed in various ways, whether as multiple components connected together or as an integral component, as discussed further herein.

As with the first example, the platform 220 of the second example preferably is constructed of relatively rigid material, such as by being constructed of cast metal, sheet metal, fiber reinforced plastic, or the like. It also may be formed in one piece with apertures and flanges as needed for mounting of pivot pins, and it is contemplated that a keyboard support tray or other more expansive work surface may be connected to the platform for supporting one or more data entry/input devices.

The pivotal connection of forward end 222 of the first link 214 to the control head 218 is via a laterally extending pin 224, while the pivotal connection of the rearward end 226 of the first link 214 to the base 212 is via a laterally extending pin 228. Somewhat similarly, the pivotal connection of forward end 230 of the second link 216 to the control head 218 is via a laterally extending pin 232, while the pivotal connection of the rearward end 234 of the second link 216 to the base 212 is via a laterally extending pin 236.

Figure 15:
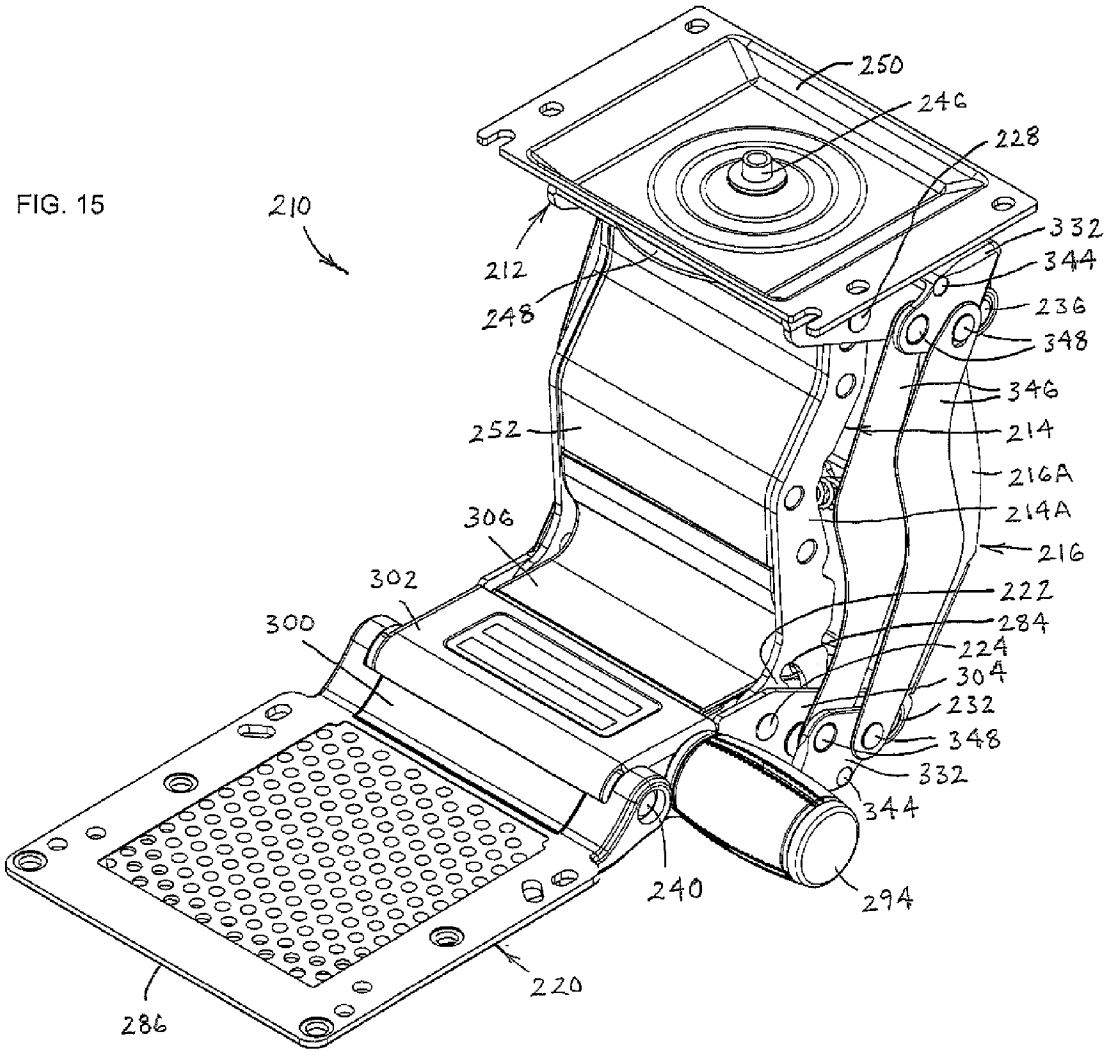
FIG. 15 is a front upper perspective view of the example articulating support arm shown in FIG. 14, in a position wherein the platform is at the bottom of the pivotal movement between the forward fully extended and rearward fully retracted positions.
Figure 16:
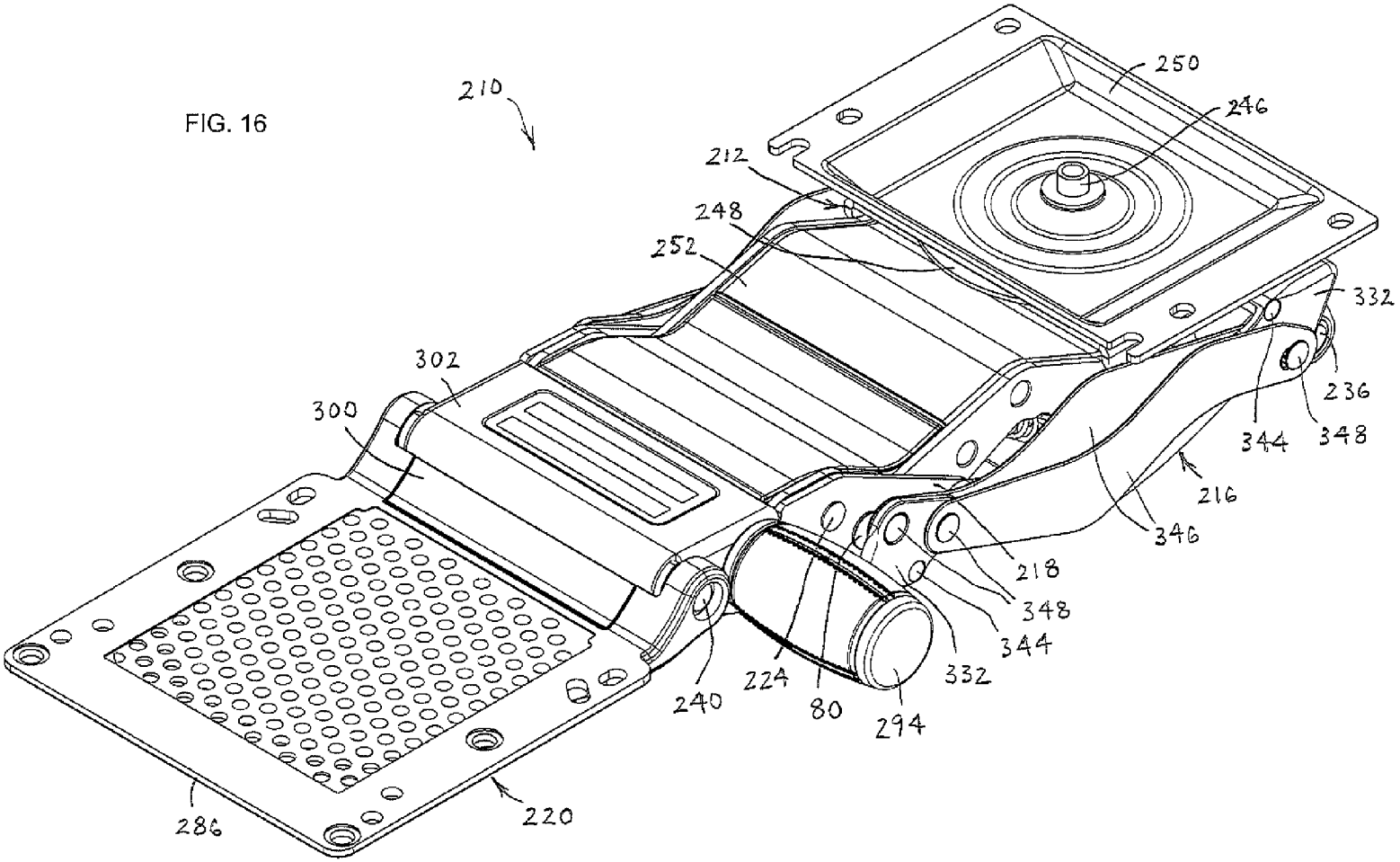
FIG. 16 is a front upper perspective view of the example articulating support arm shown in FIG. 14, in a forward fully extended position.
Figure 17:
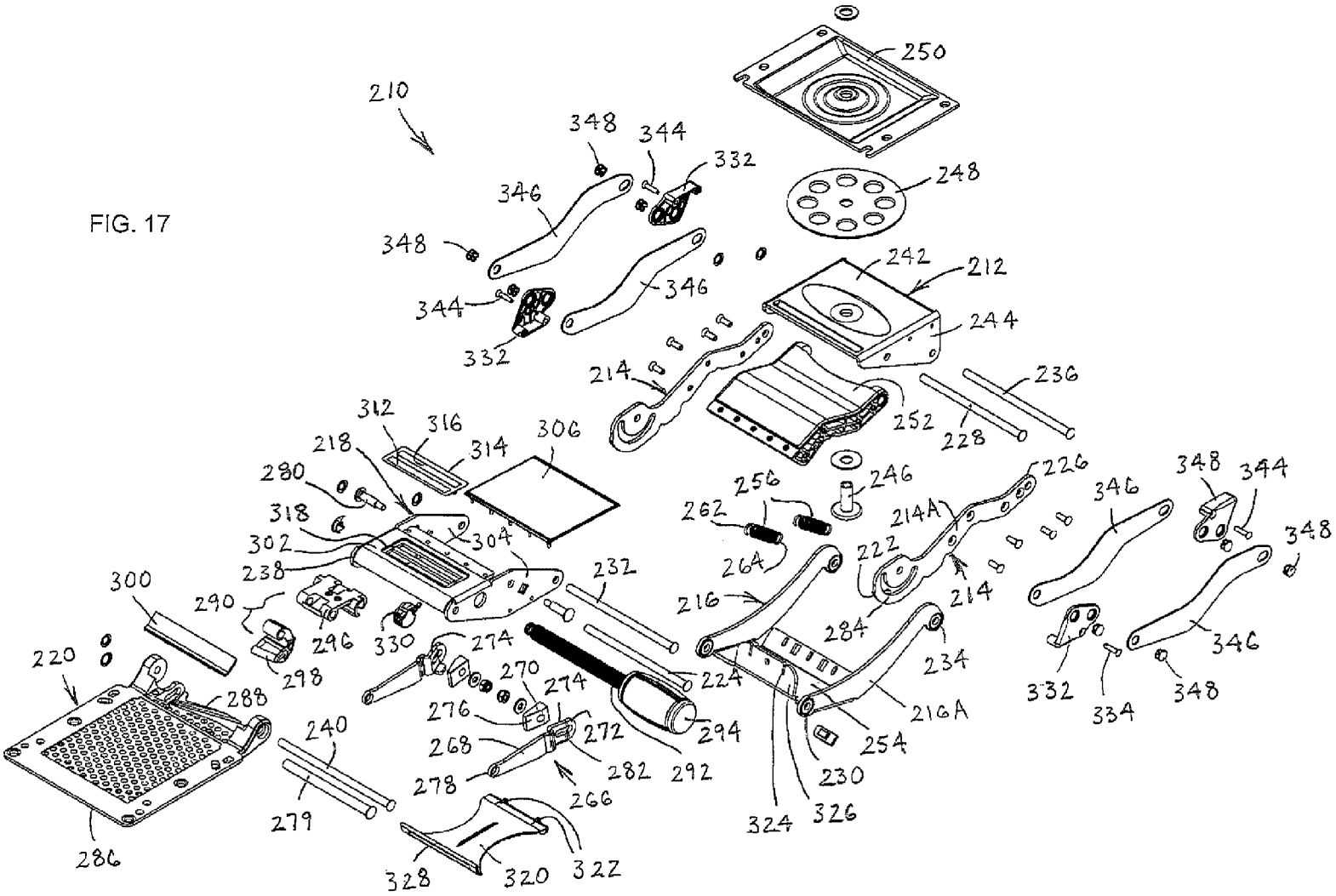
FIG. 17 is a front upper perspective exploded view of the example articulating support arm shown in FIG. 14.
Figure 18:
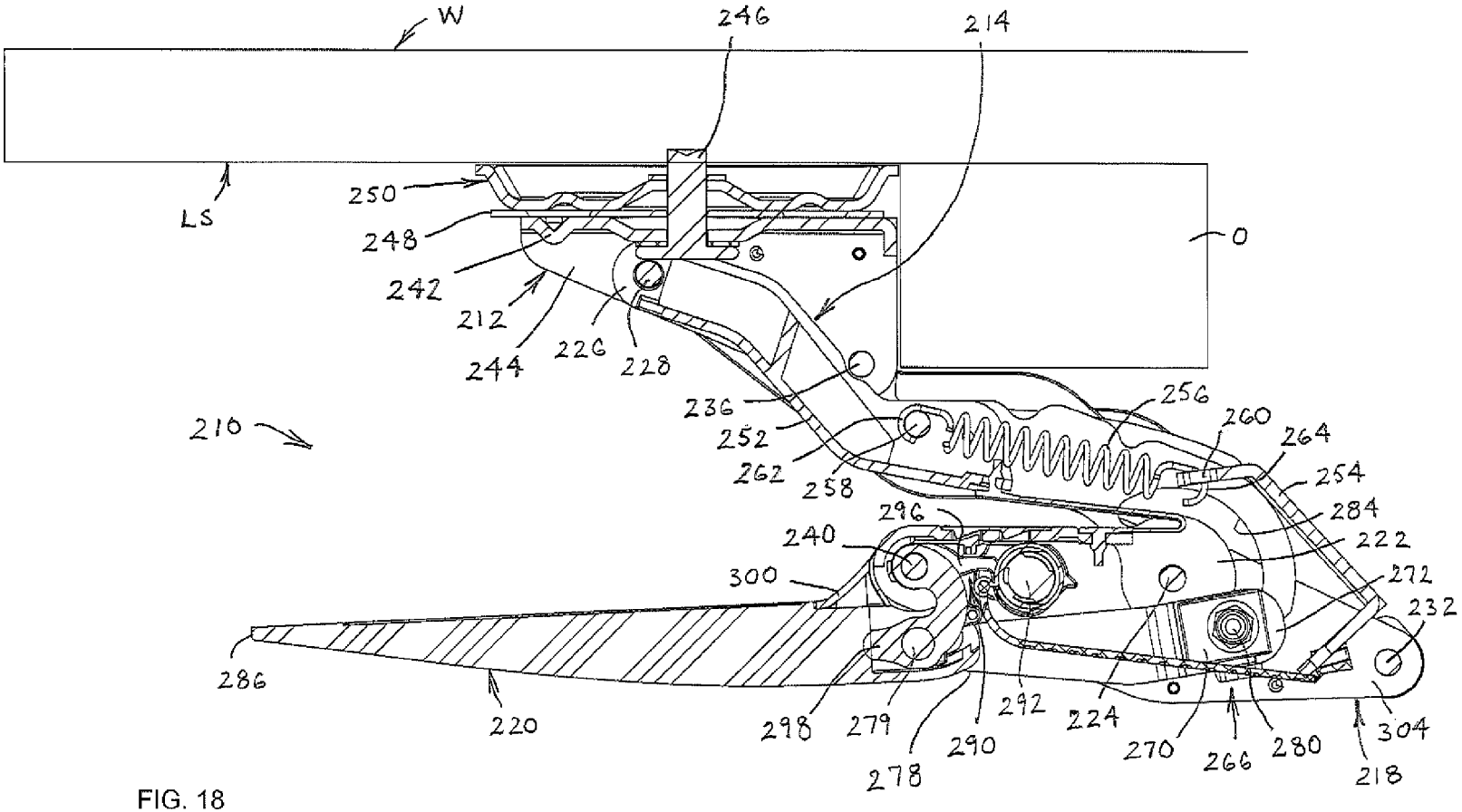
FIG. 18 is a cross-sectional side view of the example articulating support arm shown in FIG. 14, in a rearward fully retracted position below a workstation having an obstruction in the form of a support beam extending downward from the lower surface of the workstation.
Figure 19:
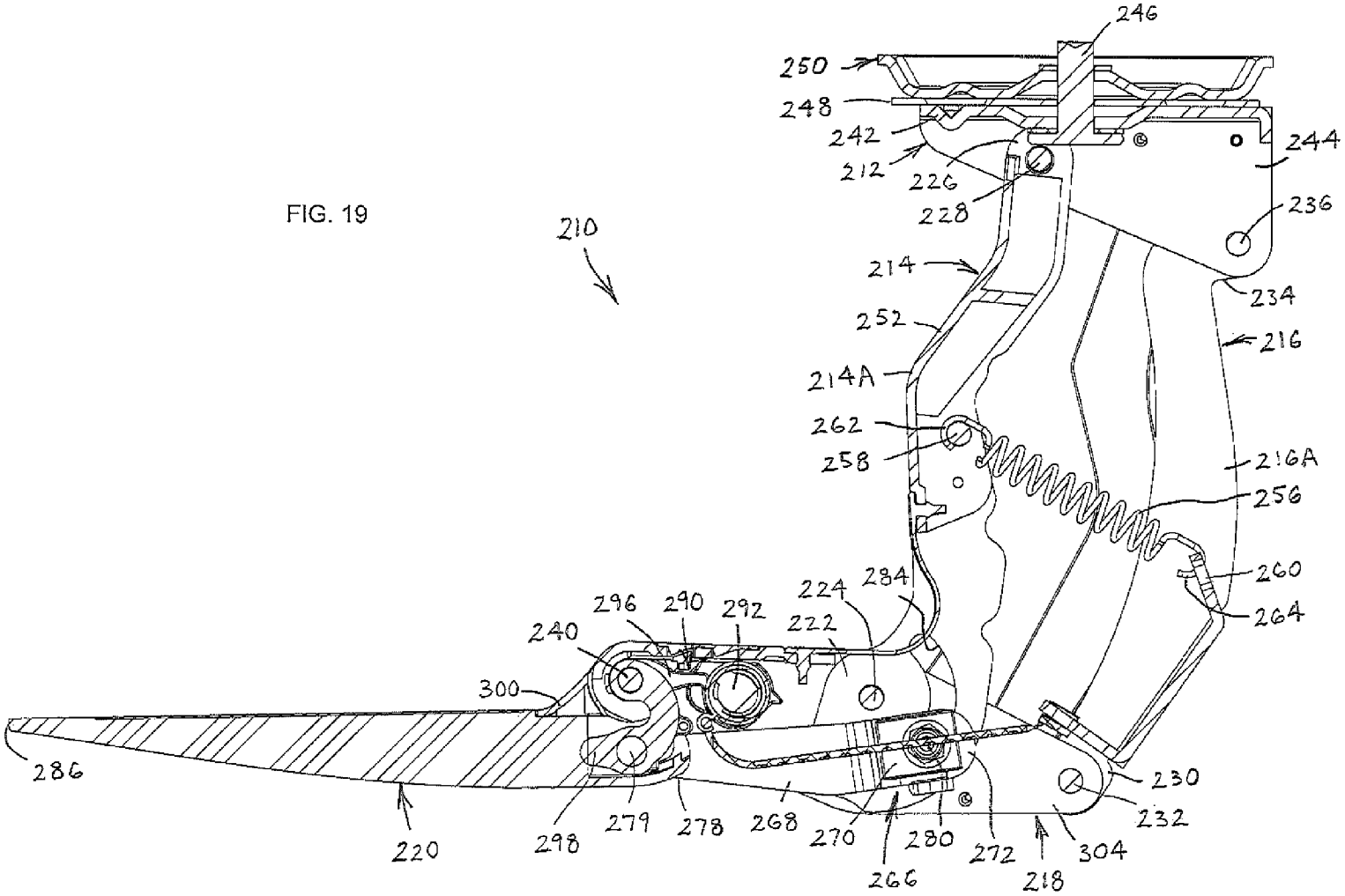
FIG. 19 is a cross-sectional side view of the example articulating support arm shown in FIG. 14, in a position wherein the platform is at the bottom of the pivotal movement between the forward fully extended and rearward fully retracted positions.
Figure 20:
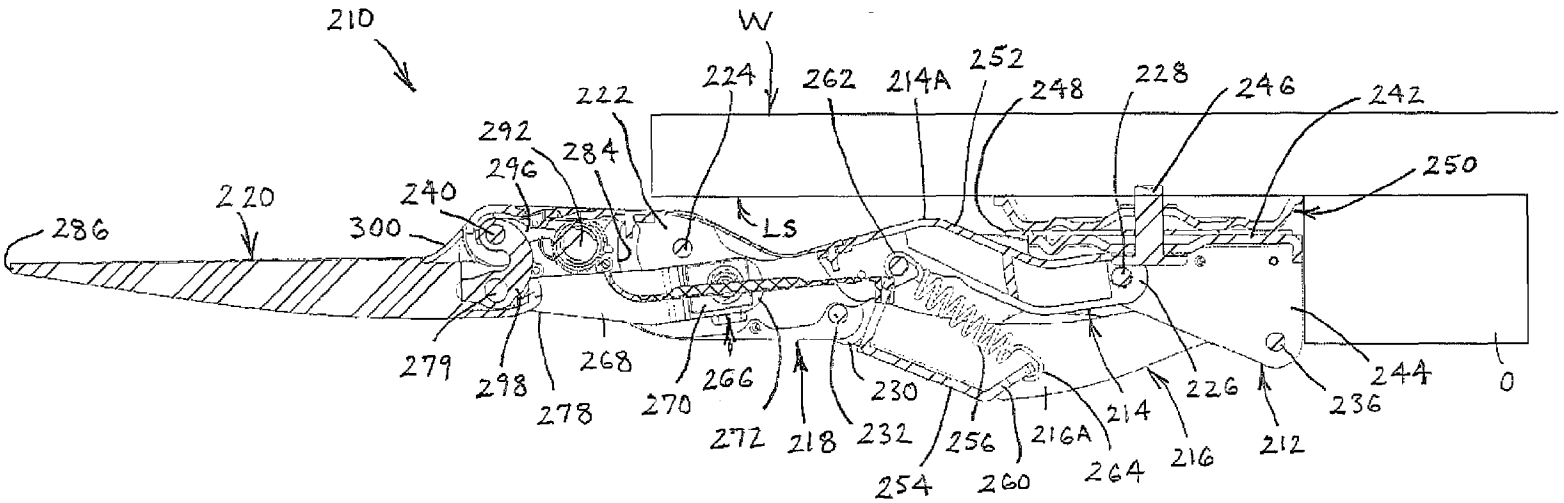
FIG. 20 is a cross-sectional side view of the example articulating support arm shown in FIG. 14, in a forward fully extended position.
Figure 21:
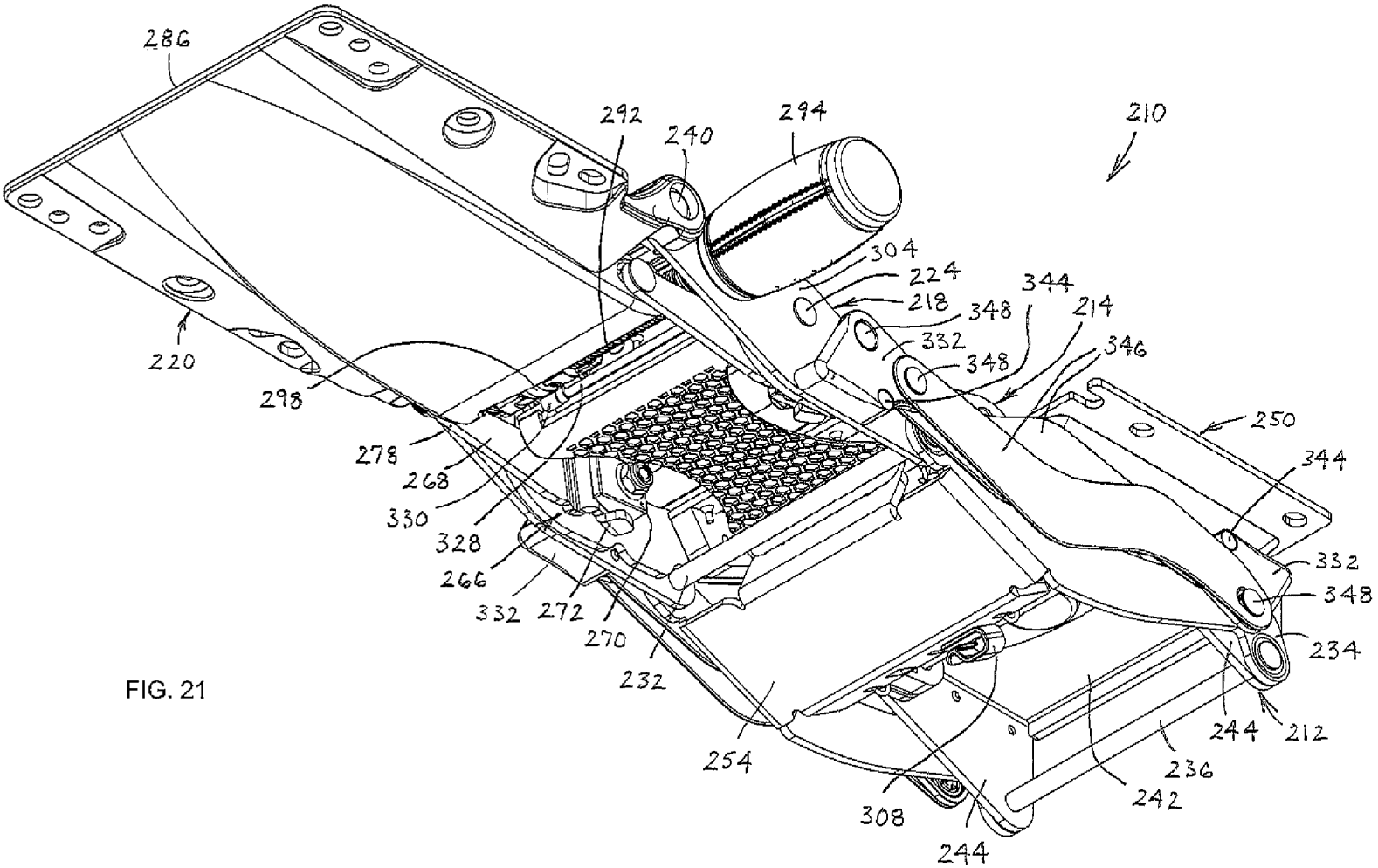
FIG. 21 is a front lower perspective view of the example articulating support arm shown in FIG. 14, in a forward fully extended position.

It will be appreciated that in the second example, similarly to the first example, the pivotal connections among the base 212, the first and second links 214, 216 of the second example and the control head 218, via the generally parallel pins 228, 236, 224, 232, form a four bar linkage. The first and second links 214, 216 each have a non-linear configuration or shape, which permits the pivotal connections of the second link 216 to the base 212 and control head 218 to be spaced rearward of the pivotal connections of the first link 214 to these components, and result in a four bar linkage having a quite shallow configuration. This can be seen for instance in FIGS. 17 and 20 with the articulating support arm 210 in a forward fully extended position. Indeed, central portions 214A, 216A of the first and second links 214, 216 are quite close together when the articulating support arm 210 is in the forward fully extended position, are quite close together and include portions that are parallel and in a generally horizontal orientation when in the rearward fully retracted position shown in FIGS. 14 and 18, and have their central portions 214A, 216A furthest apart when in an intermediate position, such as is shown in FIGS. 15 and 19. As can be appreciated when viewing FIGS. 14-16 and 18-20, by utilizing the four bar linkage, the platform 220 has the same orientation relative to a horizontal plane when in the forward fully extended position and after being moved to the rearward fully retracted position. Thus, the articulating support arm 210 may be adjusted vertically, without changing the tilt angle or orientation of the platform 220.

As with the first example, the control head 218 of the second example has a forward end 238 pivotally connected to the platform 220. This pivotal connection is achieved with a laterally extending pin 240. With this configuration, the platform 220 is movable from a forward fully extended position, which may be seen in FIGS. 16 and 20-23, wherein the control head 218 is forward of the base 212, to a rearward fully retracted position, which may be seen in FIGS. 14 and 18, wherein the control head 218 passes below and to a position rearward of the base 212. It will be appreciated that the first and second links 214, 216 extend forward from the base 212 when the platform 220 is in the forward fully extended position and extend rearward from the base 212 when the platform is in the rearward fully retracted position.

Additional FIGS. 15 and 19 are provided to show the relative positioning of the first and second links 214, 216 when in a further location, which may be an intermediate position during movement of the articulating support arm 210 between the forward fully extended and rearward fully retracted positions wherein the control head 218 is passing below the base 212, or potentially could be a stationary lowered position for use, as the platform 220 is forward of the base 212.

In this second example, the base 212 of the articulating support arm 210 is in the form of a clevis, which may be constructed of any suitable relatively rigid materials, such as cast metal, sheet metal, molded plastics, or the like. Thus, the base 212 has a U-shape that includes a body 242 and downward extending side walls 244 having apertures for receipt of pins 228, 236. The body 242 is pivotally connected by an axle 246 and a bearing 248 to a swivel plate 250.

It will be appreciated that the base 212 is configured to be coupled to a workstation, which may be in various forms, such as a table, desk, shelf, credenza or the like. This is represented schematically, for example, in FIGS. 18 and 20, where a workstation W is in the form of a table having a tabletop. The tabletop of the workstation W has a lower surface LS, from which an obstruction O extends downwardly, where the obstruction O is represented as a laterally extending support beam. With respect to coupling to the workstation W, if it is desired that the articulating support arm 210 only be movable in a path directly forward and rearward and via the pivotal connections of the base 212, first and second links 214, 216 and control head 18, then the base 212 may be coupled to the workstation by connecting the body 242 directly to the lower surface LS of the workstation W, such as by use of screws extending through appropriately drilled holes in the body 242, or by use of other suitable connecting structures. However, if it is desired that the articulating support arm 210 also be able to swivel or pivot to the left or right, then it may be coupled to the workstation W by pivotally connecting the base 212 to the swivel plate 250 and then directly connecting the swivel plate 250 to the lower surface LS of the workstation W. Alternatively, if space permits, there are not obstructions and it is desired to provide further fore and aft movement, then the base 212 may be coupled to the workstation W by directly connecting a track to the lower surface LS of the workstation W in a conventional manner, such as by screws or other connecting structures, and slidably connecting the base 212 and/or swivel plate 250 to the track, so as to also be able to extend the reach or total distance which the articulating support arm 210 may travel between a forward fully extended position and a rearward fully retracted position. Thus, as seen in FIG. 18, when the base 212 is coupled to a lower surface LS of a workstation W and the platform 220 is moved to the rearward fully retracted position, the non-linear configuration of the first and second links 214, 216 provides space above the first and second links 214, 216 to accommodate an obstruction O on the lower surface LS of the workstation W. In the second example, the swivel plate 250 is configured for fixed attachment to the lower surface LS of a workstation W and is wider than the swivel plate 50 of the first example, which is configured to optionally be slidably received by a track.

The first links 214 are shown as being connected to and by an upper body 252 that spans between them. Somewhat similarly, the second links 216 are shown as being connected to and by a lower body 254. It will be appreciated that the upper and lower bodies 252, 254 are optional and may be separate pieces that are connected by fasteners, such as is shown with upper body 252, or by other suitable means of connections, such as by welding or the like, or may be integrally formed with the links, such as is shown with lower body 254. Thus, the first and second links 214, 216 may be constructed of separate parallel components and may include a lateral portion, whether constructed as an assembly or as an integral component. As such, the components within the first and second links and the upper and lower bodies may be constructed of relatively rigid materials, such as cast metal, sheet metal, molded plastics, or the like. The upper and lower bodies 252, 254 have at least three functions in that they act as shrouds to provide a cleaner, more pleasing product appearance, cover much of the mechanical structures that might otherwise present pinch points, and provide connection points for coupling one or more resilient members 256 to the first and second links 214, 216.

In the second example, as may be seen in FIGS. 18-20 and 22-23, the underside of the upper body 252 includes a holding element 258 in the form of a rod that faces toward the lower body 254, while the lower body 254 includes a holding element 260, in the form of a flange that extends toward the upper body 252. The resilient member 256 is shown as a spring that includes first and second ends 262, 264 and a coiled central portion by which it may provide tension when the first and second ends 262, 264 are moved away from each other. The holding elements 258, 260 provide a rod and apertures that are in opposed locations, such that the rod of holding element 258 receives a first end 262 of a resilient member 256 while an aperture in the opposed holding element 260 receives a second end 264 of the same resilient member 256. Having a resilient member 256 coupled to the first and second links 214, 216 tends to bias the support arm to move upward toward the forward fully extended position or toward the rearward fully retracted position. This may be helpful to a user when moving and effectively lifting to a position for use or to be stowed, and may help avoid a sudden downward drop when the articulating support arm 210 is unlocked to permit movement.

With respect to locking, the articulating support arm 210 includes a locking assembly 266 that holds the support arm, and therefore the platform 220, in a selected position at or between the forward fully extended position and the rearward fully retracted position. The locking assembly 266 includes at least one locking link 268 and at least one wedge member 270. The locking link 268 has a rearward end 272, and the rearward end 272 of the locking link 268 and the wedge member 270 have respective opposed complementary angled surfaces 274, 276 that slidably engage each other. The locking link 268 has a forward end 278 pivotally connected to the platform 220 at a pin 279 and the rearward end 272 is pivotally connected to the control head 218 and to the first link 214. The pivotal connection of the rearward end 272 of the locking link 268 to the control head 218 includes a pivot shaft or pin 280 that extends through the wedge member 270, the locking link 268, the first link 214 and the control head 218, and that includes a head, nut or other suitable means at each end to capture within the length of the pin 280 the components that may move axially along its captured length. Thus, the pivot pin 280 extends through an aperture in the wedge member 270, a linear slot 282 in the rearward end 272 of the locking link 268, and through an arcuate slot 284 in the forward end 222 of the first link 214, and the captured length of the pin 280 may be a length that is somewhere between the minimum and maximum thickness or axial dimension of the combined aforementioned components through which the pin 280 extends, while also accounting for any washers or other less significant components therebetween. The arcuate slot 284 permits the pin 280 to move or slide therein as the first link 214 pivots relative to the control head 218, when the locking assembly 266 is unlocked.

It will be appreciated that the locking assembly 266 of the articulating support arm 210 may be easily and conveniently unlocked. When a forward edge 286 of the platform 220 is tilted upward, pivoting about the pin 240, the locking link 268 that is pivotally connected to the platform 220 at the pin 279 is moved forward relative to the control head 218, and therefore, pulls the wedge member 270 forward. This unlocks the pivotal connection of the control head 218 to the first link 214 wherein the articulating support arm 210 may then be move to a selected position at or between the forward fully extended position and the rearward fully retracted position. Thus, when the wedge member 270 is pulled forward and its angled surface 276 slides relative to the angled surface 274 of the locking link 268, the combined thickness of the components of the locking assembly 266 decreases and the locking assembly 266 is decompressed, removing the compression between the surfaces of the first link 214 and the control head 218 that otherwise effectively locked them due to the increased friction caused by the compression that is present when the platform 220 is released and the articulating support arm 210 is at rest in a selected position.

Hence, by tilting the forward edge 286 of the platform 220 upward, the effective compression lock is removed and the components of the four bar linkage are permitted to pivot relative to each other, wherein the position of articulating support arm 210 may be adjusted by moving the platform 220 to a new selected position at or between the forward fully extended position and the rearward fully retracted position. Once the desired position is reached, the platform 220 may be released and the downward force associated with the rest position will cause the locking link 268 to move the wedge member 270 back into a position to compress the components of the locking assembly 266, thereby locking the articulating support arm 210 in the desired position. Accordingly, to a user, the locking assembly 266 provides intuitive, simple, one-handed operation, without any need to see the operation of the components that are unlocking or locking. Additional benefits include the lack of use of cables or other components that may require readjustment as they wear. The wedge member 270 preferably is relatively rigid and may be constructed of any suitable relatively rigid materials, such as cast metal, sheet metal, molded plastics, or the like. Indeed, as the wedge member 270 wears, the locking assembly 266 is effectively self-adjusting because the angled surfaces 274, 276 will move over each other until the combined thickness of the portions of the locking link 268 and wedge member 270 are sufficient to bind or lock the first link 214 relative to the control head 218.

It will be noted that additional advantages may be provided if the wedge member 270 is constructed of a plastic material, such as to promote smooth sliding, quiet operation and a relatively inexpensive wear part, if the wedge member 270 should ever need to be replaced. As noted previously, the four bar linkage within the articulating support arm 210 allows unlocking of the locking assembly 266 and a height adjustment of the support arm 210 while essentially retaining the same orientation of the platform 220 relative to a horizontal plane. The arcuate slot 284 in the forward end 222 of the first link 214 allows the articulating support arm 210 to pivot or be moved through an extensive angular range of motion, which if desired may be as much as 120-140 degrees. This is unlike known devices which do not tend to have a configuration that would permit a significant portion of a support arm to pass below and rearward of a base, and therefore, tend to have angular travel of no more than 90 degrees.

As previously noted, while an articulating support arm may be constructed with a preset orientation of the platform relative to a horizontal plane, with such preset orientation being maintained throughout the height adjustment of the articulating support arm, the example shown also provides for adjustment of the orientation of the platform 220 relative to a horizontal plane, which may otherwise be referred to as tilt adjustment of the platform 220. As shown, the platform 220 includes an angled abutment 288 that engages a slider 290 extending between the angled abutment 288 and a shaft 292 that is rotatably connected to the control head 218. The slider 290 is rotatably connected to and driven by the shaft 292. In this example, this driving motion is achieved by having the shaft 292 and the slider 290 have corresponding screw threads thereon to cause the slider 290 to move along the shaft 292 when the shaft 292 is rotated. The shaft 292 has a knob 294 fixedly connected to one end to permit a user to quickly and easily rotate the shaft 290 to perform a tilt adjustment, thereby changing the pitch or angle of inclination of the platform 220.

Figure 22:
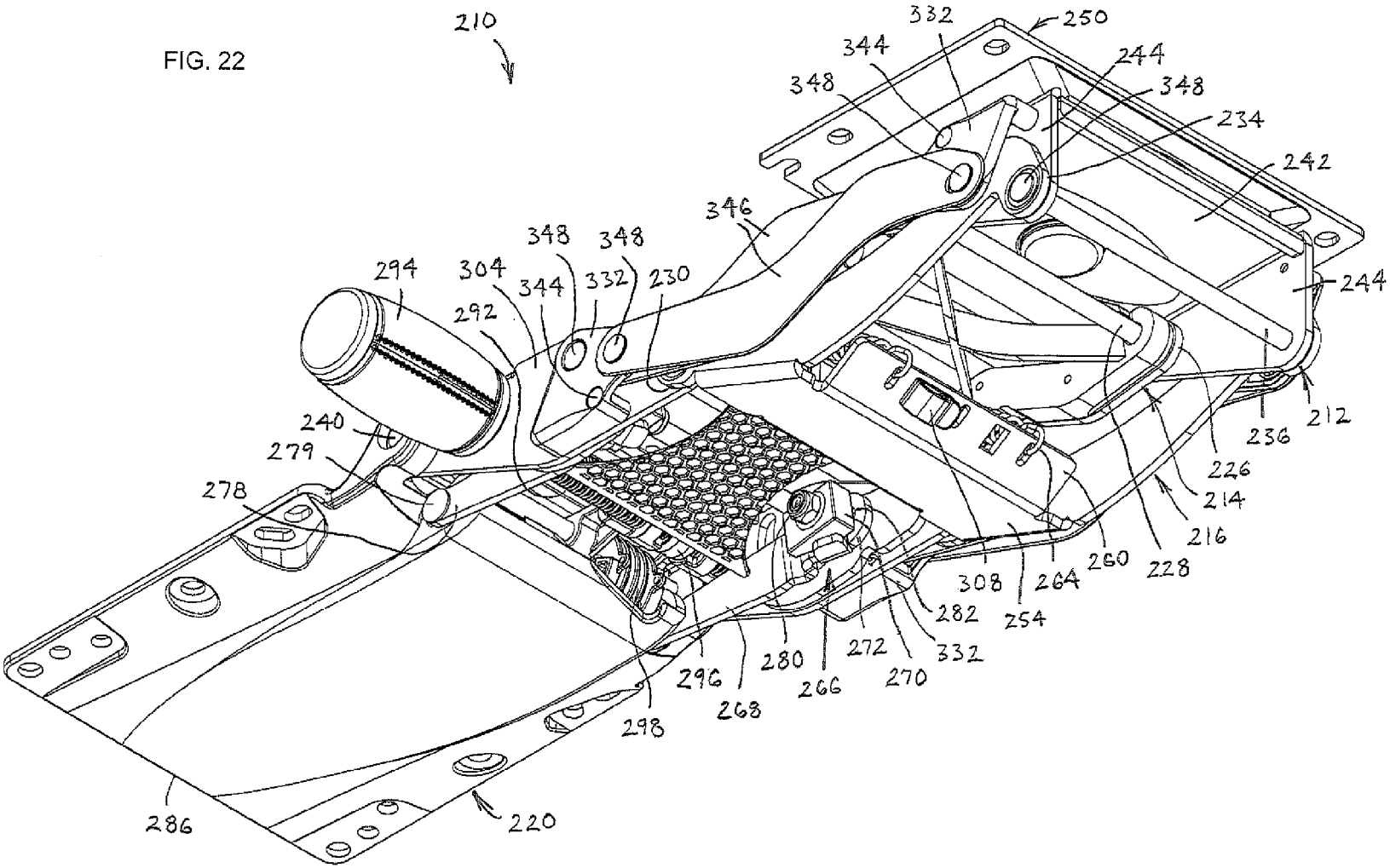
FIG. 22 is a rear lower perspective view of the example articulating support arm shown in FIG. 14, in a forward fully extended position.
Figure 23:
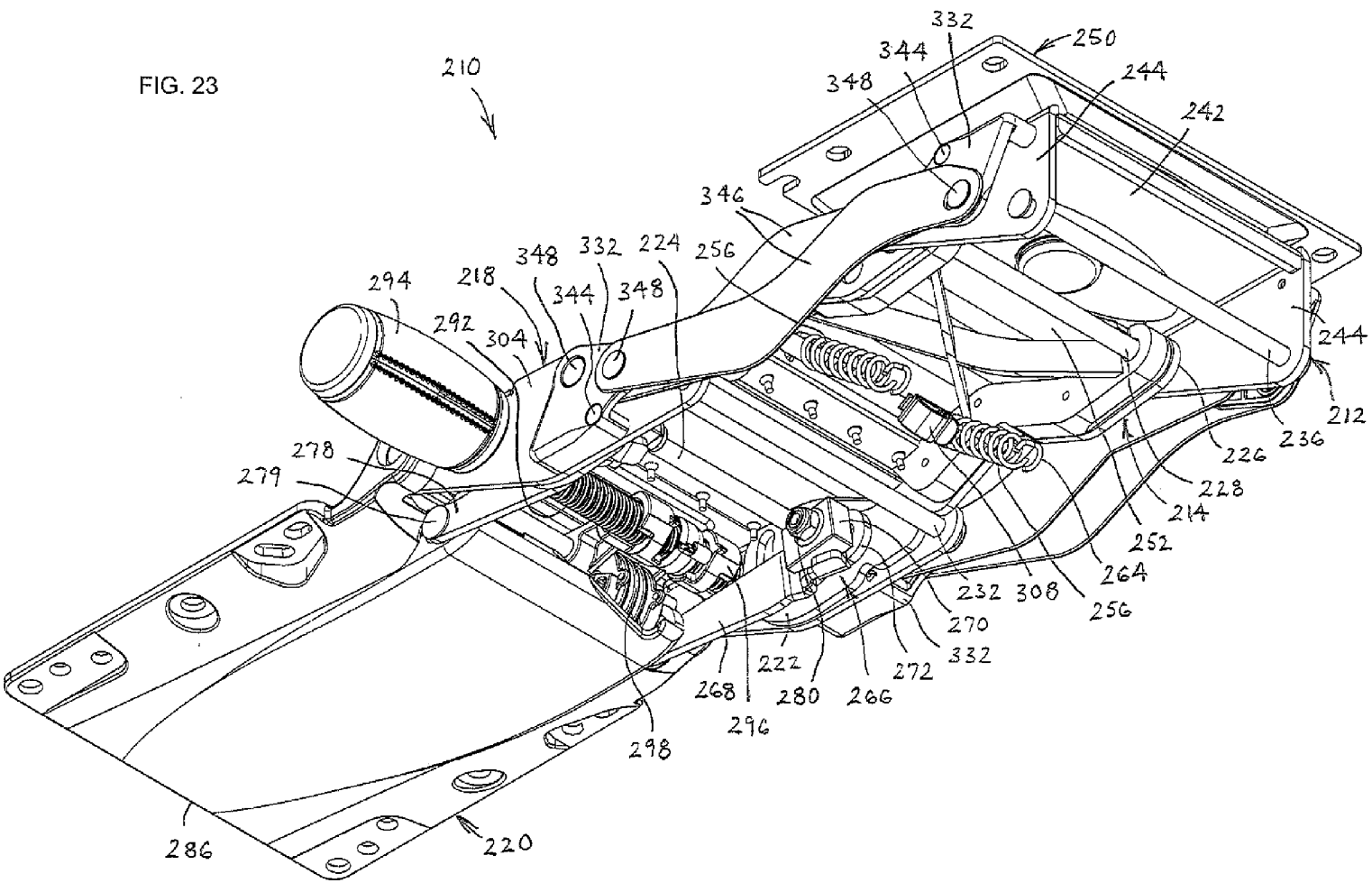
FIG. 23 is a rear lower perspective view of the example articulating support arm shown in FIG. 14, in a forward fully extended position and having the second link removed to permit viewing of the coupling of the resilient members to the first link.

While the slider 290 could be constructed of a single piece, but in the second example shown, as may be seen in FIGS. 17-23, and similarly to the corresponding components in the first example in FIGS. 11-13B, the slider 290 is if two-piece construction, having an upper portion 296 that engages the shaft 292 and a lower portion 298 that engages the angled abutment 288 on the platform 220. Thus, the lower portion 298 of the slider 290 and the angled abutment 288 have complementary angled surfaces that slidably engage each other and cause the platform 220 to tilt as the slider 290 moves along the shaft 292. In this configuration, the platform 220 is pivotally connected to the control head 218 by the pin 240 that is parallel to the shaft 292. Further, the slider upper portion 296 engages the shaft 292, and to keep from rotating with the shaft 292 the slider upper portion 296 also slidably engages the pin 240. In the configuration shown, the slider upper portion 296 includes a U-shape which straddles and engages the slider lower portion 298 at their slidable connection to the pin 240. When the knob 294 is turned, the slider lower portion 298 is pushed toward one side or the other by the slider upper portion 296 and to maintain its orientation relative to the angled abutment 288, the slider lower portion 298 slidably engages the pin 279, as well as the pin 240. FIGS. 22-23, and corresponding FIGS. 12A-13B of the similar components within the first example, are particularly useful in showing the relative positioning of the slider 290 on the angled abutment 288 and the resulting range of tilt adjustment when the knob 294 and shaft 292 are rotated from one extreme to the other. It will be appreciated that the slider 290 preferably is constructed of relatively rigid materials, such as cast metal, molded plastics, or the like.

During assembly, the slider 290 may be installed on the pin 240 that pivotally connects the control head 218 to the platform 220. Thus, the slider 290 need not be installed on the platform 220 but simply engages the angled abutment 288. In this example, the angled abutment 288 is integral with the platform 220. This can be very efficiently achieved during manufacture of the platform 220. Alternatively, a separate angled component could be connected to the rear of the platform 220 to be engaged by the slider 290. It will be appreciated that, in a further alternative, the angled abutment 288 could be configured so that the slider 290 is slidably connected to the angled abutment 288, such as within a channel, as opposed to simply slidably contacting a surface of the angled abutment 288.

With the example shown and described above, the articulating arm 210 may be adjusted to position the platform 220 for use or stowage below a workstation, and the tilt adjustment or orientation of the platform 220 relative to a horizontal plane may be separately adjusted, if desired. The articulating support arm 210 may include further components to enhance the appearance and safety of the device, such as a front shroud 300 to cover the tilt adjustment assembly, a shroud 302 that is integrally formed with the control head 218 as it spans between two side walls 304, a cover 306 that closes the area between the shroud 302 and the upper body 252, and a cable management clip 308 that may be seen in FIGS. 21-23 connected to the holding element 260 of the lower body 254, to hold one or more cables that may be associated with a data entry/input device. These components, as well as the control head 218, may be constructed of suitable materials, such as cast metal, sheet metal, molded plastics, or the like.

The second example articulating support arm 210 also may include tilt and height indicators, for the convenience of one or more users that wish to return to a prior setting or to have a visual indication of a tilt adjustment being made to the platform 220. For instance, the upper portion 296 of the slider 290 may include an upward projection 310 to form a needle that will travel laterally and be visible through an opening in the shroud 302 of the control head 218. The upward projection 310 may be seen through a first window 312 of a cover 314 that also has a second window 316. The cover 314 is at least partially transparent and may be connected to the shroud 302 of the control head 218, such as at a recess 318 by friction or snap fit, or by use of adhesives of the like. As the slider 290 moves laterally and its lower portion 298 engages and moves the angled abutment 288 at the rear of the platform 220, the projection 310 on the upper portion 296 will move laterally along the first window 312, which may have tilt or angled position related indicia, such as may be enumerated in a range of angles or other units, etched, embossed, printed or the like along the edge of the first window 312 to conveniently inform the user of the relative tilt position or angle of the platform 220.

The articulating support arm 210 of the second example also includes a height indicator, for the convenience of one or more users that wish to return to a prior setting or to have a visual indication of a height adjustment being made to the platform 220. In particular, a wand 320 includes T-shaped connectors 322 at a rearward end that slidably engage slots 324 on an upstanding flange 326 of the body 254 of the second link 216. The forward end of the wand 320 includes an elongated rod 328 with a slot below it, and the rotary height indication gauge 330 slides on the rod 328 and displays height position related indicia, such as may be enumerated in a range of units, that are shown through the second window 316 of the cover 314. As the platform is raised and lowered, the wand 320 drives the rotary position of the height indication gauge 330, so as to display the height position indicia to conveniently inform the user of the relative height position of the platform 220. The tilt and height indication components may be constructed of suitable materials, such as molded plastics, cast metal, sheet metal or the like.

The second example articulating support arm 210 further includes elongated side shroud elements to prevent casual or accidental access to the inner workings between the first and second links 214, 216. Shroud mounting brackets 332 are configured to be used in opposed positions wherein they are connected to the side walls 304 of the control head 218 and to the side walls 244 of the base 212. The connection may be made using suitable separate fasteners 344, such as self-tapping screws, rivets or the like, or by having integral fastening features, such as snap-in pins or the like. Side shroud elements 346 are pivotally mounted at their ends to the respective shroud mounting brackets 332, such as by push pins 348 or the like. The elongated side shroud elements 346 block entry, so as to avoid pinch points or other harm to the user.

It will be appreciated that the disclosed examples described present numerous potential combinations of elements for articulating support arms and methods of their use. Thus, while the present disclosure shows and describes various example articulating support arms that may be adapted for connection to a workstation and for use with data entry/input devices, such as a keyboard, the examples are merely illustrative and are not to be considered limiting. Indeed, it will be apparent to those of ordinary skill in the art that various articulating support arms may be constructed and configured for use in supporting one or more data entry/input devices, without departing from the scope or spirit of the present disclosure. Thus, although certain example methods, apparatus and articles of manufacture have been described herein, the scope of coverage of this patent is not limited thereto. On the contrary, this patent covers all methods, apparatus and articles of manufacture fairly falling within the scope of the appended claims either literally or under the doctrine of equivalents.

I claim:

1. An articulating support arm comprising:

a base;

a first link having a forward end having a pivotal connection to a control head and a rearward end having a pivotal connection to the base;

a second link having a forward end having a pivotal connection to the control head at a location spaced rearward of the pivotal connection of the forward end of the first link to the control head, and the second link having a rearward end having a pivotal connection to the base at a location spaced rearward of the pivotal connection of the rearward end of the first link to the base, wherein a four bar linkage is formed by the pivotal connections of the base with the rearward ends of the respective first and second links and the pivotal connections of the control head with the forward ends of the respective first and second links;

the control head further having a forward end having a pivotal connection to a platform;

the platform being movable from a forward fully extended position to a rearward fully retracted position;

wherein when the platform is in the forward fully extended position the platform extends forward from its pivotal connection to the control head, and the control head extends forward from its respective pivotal connections to first and second links, and the first and second links extend forward from their respective pivotal connections to the base; and wherein when the platform is moved to the rearward fully retracted position the platform extends forward from its pivotal connection to the control head, and the control head extends below and rearward of the base as the control head extends rearward from its respective pivotal connections to the first and second links, and the first and second links extend rearward from their respective pivotal connections to the base.

2. The articulating support arm of claim 1 wherein the platform is movable to any position at or between the forward fully extended position and the rearward fully retracted position.

3. The articulating support arm of claim 1 wherein the platform has the same orientation relative to a horizontal plane when in the forward fully extended position and after being moved to the rearward fully retracted position.

4. The articulating support arm of claim 1 wherein the first and second links each have a non-linear configuration wherein central portions of the first and second links extend in a parallel generally horizontal orientation when in the rearward fully retracted position.

5. The articulating support arm of claim 4 wherein when the platform is moved to the rearward fully retracted position, the non-linear configuration of the first and second links provides space above the first and second links and below the height of the base.

6. The articulating support arm of claim 1 wherein a resilient member having opposed ends is coupled to respective central portions of the first and second links and the resilient member tends to bias the support arm to move upward toward the forward fully extended position or toward the rearward fully retracted position, as the opposed ends of the resilient member move closer toward each other when the support arm moves toward the forward fully extended position or toward the rearward fully retracted position.

7. The articulating support arm of claim 6 wherein the resilient member is a spring.

8. The articulating support arm of claim 1 wherein the base is connected to a swivel plate.

9. The articulating support arm of claim 1 further comprising a locking assembly that holds the platform in a selected position at or between the forward fully extended position and the rearward fully retracted position.

10. The articulating support arm of claim 9 wherein the locking assembly further comprises a locking link and a wedge member.

11. The articulating support arm of claim 10 wherein the locking link has a pivotal connection at a forward end to the platform and a pivotal connection at a rearward end to the control head and to the first link.

12. The articulating support arm of claim 11 wherein the pivotal connection at the rearward end of the locking link to the control head includes a pivot shaft that extends through the wedge member, the locking link, the first link and the control head.

13. The articulating support arm of claim 12 wherein the pivot shaft extends through a linear slot in the rearward end of the locking link and through an arcuate slot in the forward end of the first link.

14. The articulating support arm of claim 13 wherein the rearward end of the locking link includes an angled surface that is complementary to and slidably engages an angled surface on the wedge member.

15. The articulating support arm of claim 14 wherein when a forward edge of the platform is tilted upward, the pivotal connection of the locking link to the platform and the angled surface of the rearward end of the locking link that is complementary to the angled surface on the wedge member causes the locking link to pull the wedge member forward and sliding of the relative complementary angled surfaces reduces a combined thickness of the locking link and the wedge member, which reduces compression at and unlocks the pivotal connection at the control head to the first link wherein the articulating support arm is movable to a selected position at or between the forward fully extended position and the rearward fully retracted position.

16. The articulating support arm of claim 15 wherein after a position has been selected, the forward edge of the platform is tilted downward to its rest position, which pushes the locking link and wedge member rearward and sliding of the relative complementary angled surfaces increases a combined thickness of the locking link and the wedge member, which increases compression at and locks the pivotal connection of the control head to the first link wherein the articulating support arm is able to be moved to and locked at a selected position at or between a forward fully extended position and a rearward fully retracted position.

17. The articulating support arm of claim 1 wherein the platform further comprises an angled abutment that engages a slider extending between the angled abutment and a shaft that is rotatably connected to the control head, with the slider being rotatably connected to and driven by the shaft.

18. The articulating support arm of claim 17 wherein the shaft and the slider have corresponding screw threads thereon and the slider being rotatably connected to the shaft causes the slider to move linearly along the shaft when the shaft is rotated relative to the slider.

19. The articulating support arm of claim 17 wherein the slider has an upper portion that engages the shaft and a lower portion that engages the angled abutment on the platform.

20. The articulating support arm of claim 19 wherein the lower portion of the slider and the angled abutment have complementary angled surfaces that slidably engage each other and cause the platform to tilt as the slider moves along the shaft and the complementary angled surfaces of the lower portion and the angled abutment cause displacement of platform relative to the shaft.

21. The articulating support arm of claim 17 wherein the platform is pivotally connected to the control head by a pin that is parallel to the shaft.

22. The articulating support arm of claim 21 wherein the slider has an upper portion that engages the shaft and the slider has a lower portion that slidably engages the pin.

23. The articulating support arm of claim 22 wherein the slider upper portion also extends from the shaft to the pin and slidably engages the pin.

24. The articulating support arm of claim 17 further comprising a tilt indicator having an upward projection extending from the slider and being visible through a window in the control head.

25. The articulating support arm of claim 24 wherein the tilt indicator further comprises tilt position related indicia located along an edge of the window.

26. The articulating support arm of claim 1 further comprising at least one shroud that is pivotally coupled at a first end to the base and pivotally coupled at a second end to the control head.

27. The articulating support arm of claim 26 wherein the at least one shroud further comprises two side shroud elements that are separately pivotally coupled to the base at respective first ends and separately pivotally coupled to the control head at respective second ends.

28. The articulating support arm of claim 1 further comprising a height indicator having a wand coupled to the second link at a rearward end and to a rotary gauge at a forward end.

29. The articulating support arm of claim 28 further comprising a window in the control head through which the height indicator is visible.

* * * * *